US009213250B2

(12) United States Patent
Nomura et al.

(10) Patent No.: US 9,213,250 B2
(45) Date of Patent: Dec. 15, 2015

(54) TONER

(71) Applicant: CANON KABUSHIKI KAISHA, Tokyo (JP)

(72) Inventors: Shotaro Nomura, Suntou-gun (JP); Yusuke Hasegawa, Suntou-gun (JP); Takashi Matsui, Suntou-gun (JP); Shuichi Hiroko, Susono (JP); Yoshitaka Suzumura, Mishima (JP); Atsuhiko Ohmori, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/042,241

(22) Filed: Sep. 30, 2013

(65) Prior Publication Data

US 2014/0030645 A1 Jan. 30, 2014

Related U.S. Application Data

(63) Continuation of application No. PCT/JP2013/067281, filed on Jun. 24, 2013.

(30) Foreign Application Priority Data

Jun. 27, 2012 (JP) ..... 2012-144403

(51) Int. Cl.
*G03G 9/097* (2006.01)
*G03G 9/08* (2006.01)
*G03G 9/087* (2006.01)

(52) U.S. Cl.
CPC ..... *G03G 9/0827* (2013.01); *G03G 9/0821* (2013.01); *G03G 9/08757* (2013.01); *G03G 9/09725* (2013.01)

(58) Field of Classification Search
USPC ..... 430/108.6, 108.7, 110.1, 110.3
See application file for complete search history.

(56) References Cited

U.S. PATENT DOCUMENTS 7,537,877 B2 5/2009 Yoshiba et al.
8,309,289 B2 11/2012 Anno et al.

(Continued)

FOREIGN PATENT DOCUMENTS

JP 2005-345647 * 6/2004 ..... G03G 15/08
JP 2005-345647 A 12/2005

(Continued)

OTHER PUBLICATIONS

Translation of JP 2005-345647 published Jun. 2004.*

(Continued)

*Primary Examiner* — Peter Vajda
(74) *Attorney, Agent, or Firm* — Fitzpatrick, Cella, Harper and Scinto

(57) ABSTRACT

Disclosed is a toner which enables a stable image density to be obtained, regardless of the service environment, throughout use in durability tests, and which is able to suppress the occurrence of faulty cleaning. The toner contains both toner particles, which include a binder resin and a colorant, and also silica fine particles. The toner has an average circularity of at least 0.950, a static friction coefficient, with respect to a polycarbonate resin substrate, of at least 0.100 and not more than 0.200, and a coverage ratio X1 of the toner surface by the silica fine particles, as determined by X-ray photoelectron spectroscopy (ESCA), of at least 50.0 area %, and not more than 75.0 area %.

6 Claims, 6 Drawing Sheets

(56) References Cited

U.S. PATENT DOCUMENTS

| | | | | |
|---|---|---|---|---|
| 2005/0079433 | A1* | 4/2005 | Watanabe et al. | 430/108.4 |
| 2012/0231384 | A1* | 9/2012 | Aoki et al. | 430/106.1 |
| 2013/0164044 | A1 | 6/2013 | Hasegawa et al. | |

FOREIGN PATENT DOCUMENTS

| | | | |
|---|---|---|---|
| JP | 2006-39023 | A | 2/2006 |
| JP | 2008-203785 | A | 9/2008 |
| JP | 2009-80247 | A | 4/2009 |
| JP | 2011-59586 | A | 3/2011 |
| JP | 2011-215310 | A | 10/2011 |
| JP | 2013-47754 | A | 3/2013 |

OTHER PUBLICATIONS

International Preliminary Report on Patentability, International Application No. PCT/JP2013/067281, Mailing Date Jan. 8, 2015.

* cited by examiner (a)

(b)

TONER

This application is a continuation of International Application No. PCT/JP2013/067281, filed Jun. 24, 2013, the contents of which are incorporated by reference herein.

TECHNICAL FIELD

The present invention relates to a toner for use in, for example, electrophotographic, electrostatic recording and magnetic recording methods.

BACKGROUND ART

In monochrome copiers and laser beam printers (also abbreviated below as "LBP"), single-component development systems that use magnetic toners are in wide use due largely to advantages in terms of cost and simplicity of device construction. A variety of investigations are currently underway, both on the toner and the apparatus itself, which are aimed at achieving even higher image quality in such monochrome copiers and LBPs. To enhance the image quality in monochrome copiers and LBPs, the approaches taken from the standpoint of the toner have included reducing the diameter, sharpening the size distribution and increasing the circularity of the toner particles.

When the toner has a smaller particle diameter, the resolution increases, enabling a high precision image to be obtained. When the toner has a sharp particle size distribution, the charge distribution becomes uniform, the behavior of the toner becomes uniform in the development and transfer steps, and toner which lowers image quality by, for example, jumping to non-image areas decreases.

Also, if the unevenness at the surface of toner that has been rendered highly circular could be reduced, it would be possible to uniformly add to the toner surface various external additives having the function of imparting the toner with a charging performance. This would make the charge distribution of the overall toner more uniform, thereby enhancing, as noted above, the image quality. In addition, the toner flowability would increase, improving the rise in electrostatic charge and enabling high-quality images to be obtained from the start of printing.

Where toners having a high circularity and a sharp particle size distribution were once manufactured primarily by conventional pulverization processes, such toners are today increasingly being manufactured by polymerization processes, by emulsion aggregation processes or by using a hot air current to spheronize toner particles. However, when a toner having a high circularity is not transferred and remains on the electrostatic latent image bearing member, the toner has a poor recoverability from the electrostatic latent image bearing member, so-called cleaning performance, which tends to give rise to image defects caused by faulty cleaning.

To address this problem, Patent Documents 1 and 2 adjust the amount of external additive and the external addition conditions with the aim of controlling the dynamic friction coefficients of the toner and the electrostatic latent image bearing member, Patent Document 3 suppresses adhesion between the toner and the electrostatic latent image bearing member by adding external additive having a large particle diameter, and Patent Document 4 controls the friction coefficient of the toner surface by adjusting the crystallinity of the binder resin.

However, although such approaches focused on various indicators are expected to provide some degree of improvement, because the cleaning stability during long-term use under harsh conditions such as a low-temperature environment is inadequate, a fundamental solution to the above problem is not achieved. Hence, a radical approach focused on more fundamental indicators of faulty cleaning is required.

CITATION LIST

Patent Literature

[PTL 1] Japanese Patent Application Laid-open No. 2009-80247

[PTL 2] Japanese Patent Application Laid-open No. 2011-59586

[PTL 3] Japanese Patent Application Laid-open No. 2006-39023

[PTL 4] Japanese Patent Application Laid-open No. 2008-203785

SUMMARY OF INVENTION

Technical Problems

The present invention is directed to providing a toner which resolves the above problems.

More specifically, the present invention is directed to providing a toner which has a stable image density throughout use in a durability test, regardless of the service environment, and which also is capable of suppressing the occurrence of faulty cleaning.

Solution to Problem

According to one aspect of the present invention, there is provided a toner comprising toner particles, each of which contains a binder resin and a colorant, and silica fine particles. The toner has an average circularity of at least 0.950, and a static friction coefficient, with respect to a polycarbonate resin substrate, of at least 0.100 and not more than 0.200. The coverage ratio X1 of the toner surface by the silica fine particles, as determined by X-ray photoelectron spectroscopy (ESCA), is at least 50.0 area % and not more than 75.0 area %.

Advantageous Effects of Invention

The invention relates to a toner which enables a stable image density to be obtained, regardless of the service environment, throughout use in a durability test, and which is able to suppress the occurrence of faulty cleaning.

DESCRIPTION OF EMBODIMENTS

Figure 1:
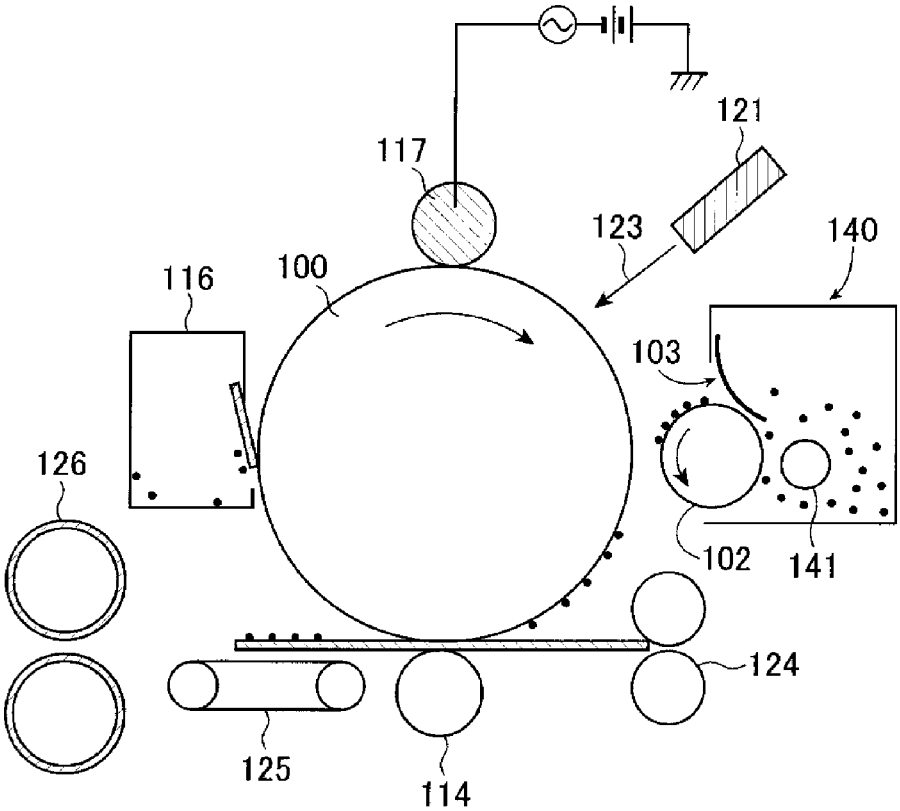
FIG. 1 is a diagram showing an example of an image-forming apparatus.

The invention is described below.

The toner of the invention is characterized by including toner particles, each of which contains a binder resin and a colorant, and including also silica fine particles. The toner has an average circularity of at least 0.950, and a static friction coefficient with respect to a polycarbonate resin substrate of at least 0.100 and not more than 0.200. The coverage ratio X1 of the toner surface by the silica fine particles, as determined by X-ray photoelectron spectroscopy (ESCA), is at least 50.0 area %, and not more than 75.0 area %.

First, the mechanism by which faulty cleaning arises is explained.

In most image-forming apparatuses such as copiers and LBPs, the toner that has flied to the electrostatic latent image bearing member is not all transferred to a recording medium such as paper; some of the toner remains on the electrostatic latent image bearing member following the transfer step (the remaining toner is referred to below as "untransferred toner"). If this untransferred toner is left on the electrostatic latent image bearing member, when the surface of the electrostatic latent image bearing member is again electrostatically charged by some means such as discharging, any segment to which the untransferred toner sticks will have an insufficient charge, making it impossible to form a suitable electrostatic latent image. As a result, image defects ultimately form.

The untransferred toner on the electrostatic latent image bearing member must be recovered before arriving at the next discharging step. This step is generally called "cleaning."

There are many such cleaning systems, although systems which use cleaning blades are the norm today.

In such a system, the end of a cleaning blade is brought into contact with the surface of the rapidly turning electrostatic latent image bearing member, thereby scraping off and removing untransferred toner which has been carried in. In practice, however, there are times where, for various reasons, this cleaning blade does not fully function and the untransferred toner is not all recovered. Such a situation is generally referred to as "faulty cleaning."

The inventors believe the mechanism by which such faulty cleaning arises to be as follows.

First, in the development step onto the electrostatic latent image bearing member, rather than behaving as single particles, in appears in fact that the toner flies in as aggregates composed of a plurality of toner particles.

With rotation of the electrostatic latent image bearing member, the aggregate borne by the electrostatic latent image bearing member reaches a cleaning zone and comes into contact with a cleaning blade. If, at this time, toner adhesion to the surface of the electrostatic latent image bearing member is high, the cleaning blade incurs a large physical impact. The force of impact causes the cleaning blade to locally vibrate, causing a gap to form between the cleaning blade and the surface of the electrostatic latent image bearing member. Faulty cleaning is thought to arise because untransferred toner ends up passing through this gap.

The inventors suspect the reason why this phenomenon tends to arise more easily in toner having a high circularity than in toner manufactured by a conventional pulverization process to be as follows.

Toner manufactured by pulverization has a highly uneven shape with a low circularity, which is thought to be why adhesion to the surface of the electrostatic latent image bearing member increases. Because, at the same time, the flowability is low and adhesion between toner particles is high, compared with toner having a high circularity, aggregates which are large and difficult to break up form. Such large, difficult-to-break-up aggregates cannot pass through gaps of the size that form due to localized vibration of the cleaning blade and, it is presumed, are scraped away by the cleaning blade.

By contrast, in toner having a higher circularity, the aggregates that form are small because, in general, adhesion between the particles is low and the flowability is high. When an aggregate collides with the cleaning blade, it is thought that the aggregate readily breaks up and easily passes through the gap that arises from the collision. The toner that has collected and re-aggregated on the end face of the cleaning blade catches on the surface of the electrostatic latent image bearing member, causing localized vibrations which are thought to give rise secondarily to faulty cleaning.

Accordingly, the inventors have conducted extensive investigations to address the problem of faulty cleaning caused by such high-circularity toner. As a result, they have discovered that this can be resolved by controlling the coverage ratio of the toner surface by silica fine particles while at the same time lowering the static friction coefficient of the toner with respect to a polycarbonate resin substrate. The details are given below.

First, an overview of the toner of the invention is provided.

By controlling the static friction coefficient of the toner with respect to a polycarbonate resin substrate, which is the primary constituent of the surface layer of the electrostatic latent image bearing member, the adhesive force of the toner to the surface of the electrostatic latent image bearing member is lowered. Lowering the adhesive force of the toner reduces the force of physical impact against the cleaning blade, suppressing the occurrence of localized vibration. In addition, it is thought that by controlling the state of adhesion by the silica fine particles to the toner surface, the toner flowability is improved, lowering the force of physical impact against the cleaning blade. At the same time, secondary aggregation of the toner at the end of the cleaning blade is apparently suppressed, thereby achieving stable cleaning.

The thinking of the inventors concerning a detailed mechanism for improving faulty cleaning is presented below.

The smaller the adhesive force of the toner to the surface of the electrostatic latent image bearing member, the smaller the force of physical impact applied by untransferred toner to the cleaning blade, making it easier to scrape off untransferred toner without causing localized vibration. The inventors have found it to be advantageous to use the static friction coefficient with respect to a polycarbonate resin substrate as an indicator of this adhesive force.

The static friction coefficient refers to a constant of proportionality that determines the frictional force (maximum static frictional force) at the moment when an object begins to move from a resting state on the surface of a test member.

When $\mu$ is the static friction coefficient and N is the vertical drag on the surface of the member, the maximum static frictional force $F_0$ is expressed by the following formula (A).

$$F_0=\mu N \quad (A)$$

This indicates that as the static friction coefficient $\mu$ becomes larger, the maximum static frictional force $F_0$ also becomes larger, and that a larger force is required to move an object in the horizontal direction over the surface of the member. In the cleaning step, a larger static friction coefficient means that a larger force of physical impact is applied when a toner aggregate comes into contact with the cleaning blade.

In addition to the static friction coefficient, there is also the dynamic friction coefficient.

The dynamic friction coefficient is thought to serve an indicator of the resistance and adhesive force when, after separating from the electrostatic latent image bearing member, the toner rolls over the electrostatic latent image bearing member. However, given the ease with which the toner is scraped off by the cleaning blade, the untransferred toner initially comes into contact with the cleaning blade while in a state of adhesion to and at rest on the surface of the electrostatic latent image bearing member. Therefore, it is more important to specify the force of physical impact that the static friction coefficient in an adhering and resting state exerts upon the cleaning blade than the dynamic friction coefficient when the toner is rolling over the electrostatic latent image bearing member.

Moreover, the static friction coefficient is generally larger than the dynamic friction coefficient, and so the physical impact forces that act on the cleaning blade are larger in the case of a toner aggregate that is in a resting state. Hence, the static friction coefficient can be regarded as playing a more dominant role in the phenomenon of localized vibration of the cleaning blade.

For this reason, the static friction coefficient is thought to be preferable to the dynamic friction coefficient as a cleaning indicator.

At the same time, another indicator for expressing adhesion to the member is the adhesive force measured by the impact method. This specifies the adhesive force, per particle that flies from the member, when a physical impact is applied to a member on which toner particles are at rest.

When one considers a cleaning framework like that discussed here, the adhesive force measured by the impact method has to do with how easily the toner is vertically dislodged from the electrostatic latent image-bearing member. However, in the series of steps by which the toner is scraped off with a cleaning blade, untransferred toner does not in fact incur impact forces vertical to the surface of the electrostatic latent image bearing member. The untransferred toner strikes the cleaning blade from a horizontal direction while adhered to the electrostatic latent image bearing member surface, and is thereby separated and scraped from the surface of the electrostatic latent image bearing member. Hence, it appears to be preferable to use, as an indicator of the ease with which toner is scraped off with the blade, the static friction coefficient which specifies the resistance to forces from a horizontal direction.

This static friction coefficient is an indicator which is meaningful only when the test member is stipulated. Strictly speaking, the static friction coefficient is determined by the combination of one member with another member.

Hence, the inventors used the static friction coefficient with respect to polycarbonate resin, which is widely used today as a constituent member of the surface layer in electrostatic latent image bearing members.

However, merely holding down the static friction coefficient of the toner with respect to the polycarbonate resin substrate, reducing the adhesion to the surface of the electrostatic latent image bearing member, and making the toner easy to scrape off with the cleaning blade is inadequate for improving the faulty cleaning of high-circularity toner.

The reason is that the following phenomenon tends to arise in toner having a high circularity. Toner that has collided with the cleaning blade and been broken from an aggregate, instead of being scraped off, collects and re-aggregates on the end face of the cleaning blade. This collected and re-aggregated toner catches on the surface of the electrostatic latent image bearing member, giving rise to localized vibration and, as a result, causing faulty cleaning. This becomes a serious problem after many pages of image formation during which the amount of collected and re-aggregated toner increases has been carried out.

The inventors believe that, in order to resolve this problem, at the same time that the static fiction coefficient is lowered, the collection and re-aggregation of toner which arises on the end face of the cleaning blade must be suppressed. As a result of investigations by the inventors, it was found to be possible, by controlling the coverage ratio of the toner surface by silica fine particles, to reduce the adhesive forces between toner particles, impart sufficient flowability to the toner, and thereby improve the cleaning performance even after many pages of image formation have been carried out.

Moreover, in toner which has a high flowability and readily breaks up, because the aggregate is smaller in size and rapidly breaks up when brought into contact with the cleaning blade, the physical impact forces that act on the cleaning blade can be reduced. Hence, it was possible to obtain a high-circularity toner which, even when used in durability tests from the start of printing, exhibits a sufficient cleaning performance.

The toner of the invention is described more concretely below.

The inventive toner has a static friction coefficient with respect to a polycarbonate resin substrate which is at least 0.100 and not more than 0.200, and is preferably at least 0.150 and not more than 0.200.

When the static friction coefficient is not more than 0.200, the adhesive force of the untransferred toner with respect to the surface of the electrostatic latent image bearing member is sufficiently low that the toner rapidly scrapes off without causing localized vibration of the cleaning blade. Also, lowering the static friction coefficient to below 0.100 would in practice make it difficult for a powder composed primarily of resin to satisfy the performance as a toner. Hence, in this invention, the lower limit in the static friction coefficient has been set to 0.100.

At a static friction coefficient of 0.200 or less, transfer of the toner image from the surface of the electrostatic latent image bearing member to paper in the transfer step is carried out smoothly, improving the transfer efficiency and increasing the final image density.

The static friction coefficient can be adjusted within the above range by regulating overall such parameters as the toner shape and surface properties, the type and amount of external additive particles, and the state of adhesion of such particles. Specifically, in cases where the average circularity of the toner is less than 0.950, even if the external additive is regulated, it is difficult to set the static friction coefficient to 0.200 or less. The reason is thought to be that, in particles having a highly uneven shape, protruding portions increase the frictional resistance with the surface of the test member. Hence, in the toner of the present invention, the average circularity must be at least 0.950. The average circularity of the toner is preferably at least 0.960, and more preferably at least 0.970.

In the toner of the invention, it is critical for the coverage ratio by silica fine particles to be at least 50.0 area % and not more than 75.0 area %.

It is indeed possible to achieve the above range in the static friction coefficient by adding a relatively large amount of, for example, metal oxide particles variously treated with fatty acids, silicone oils or the like that are commonly used as lubricants. However, these often have an adverse influence on, for example, the charging characteristics of the toner. As a result, qualities desired of the toner other than the cleaning performance, i.e., the electrophotographic characteristics, cannot be satisfied, making it extremely difficult for the toner to function as a developer. In addition, harmful effects such as contamination of the member due to external additive particles that have been liberated during use in durability tests also arise.

Hence, the inventors now think that, rather than using a large amount of a special external additive, it is important to adjust the static friction coefficient within the above range while controlling the state of silica fine particles adhesion at the toner surface. Specifically, controlling the coverage ratio by silica fine particles at the toner surface is important and, more preferably, it is desired that the uniformity of the covered state be increased. The details of the mechanism by which remarkable effects are obtained when the coverage ratio of the toner surface by silica fine particles is at least 50.0 area % and not more than 75.0 area % are not clear, but the inventors speculate the mechanism to be as follows.

By covering the toner surface to a suitable ratio with silica fine particles, a number of effects can be expected, including the following: (1) unevenness in the surface of the toner particles can be leveled out, (2) localized non-uniformities in the charge state at the toner surface following transfer can be suppressed, and (3) liberated silica fine particles is able to act as particles having a bearing effect. These elements, in combination with the low static friction coefficient, are thought to be associated with improvements in toner characteristics.

In addition, by uniformly covering the toner surface with silica fine particles, the following effects, among others, are also conceivable: (1) local exposure of the surface of toner particles having a high adhesion is suppressed, (2) the adsorption of water molecules to the toner member surface is suppressed, and (3) the formation of aggregates of the silica fine particles is suppressed, lowering frictional resistance due to steric interlocking by aggregates.

In the invention, the coverage ratio X1 of the toner surface by the silica fine particles, as determined by X-ray photoelectron spectroscopy (ESCA), is at least 50.0 area % and not more than 75.0 area %.

The coverage ratio X1 can be calculated from the ratio of the detected intensity of elemental silicon when the toner is measured by ESCA relative to the detected intensity of elemental silicon when the silica fine particle alone is measured. This coverage ratio X1 indicates the ratio of the toner particle surface area which is actually covered by silica fine particles.

When the coverage ratio X1 is at least 50.0 area % and not more than 75.0 area %, this imparts the toner with sufficient flowability and, at the same time, suitably covers the toner surface with silica fine particles, enabling adhesion between toner particles to be reduced. As a result, even in cases where toner has collected on the end face of the cleaning blade, re-aggregation does not readily occur, thus preventing faulty cleaning from arising.

In the inventive toner, when the theoretical coverage ratio of the toner by silica fine particles is X2, it is preferable for the diffusion index defined by Formula 1 below to satisfy Formula 2 below.

$$\text{Diffusion index}=X1/X2 \qquad \text{Formula 1}$$

$$\text{Diffusion index}\geq -0.0042\times X1+0.62 \qquad \text{Formula 2}$$

The theoretical coverage ratio X2 of the toner by the silica fine particles is calculated from Formula 4 below using, for example, the content of silica fine particles in the toner and the particle diameter of the silica fine particles. The theoretical coverage ratio X2 determined by Formula 4 below expresses, as a percentage, the value obtained by first dividing the total projected surface area of the external additive by the total surface area of the toner particles, then dividing this result by the proportion of the area on a flat surface where circles of the same radius are arranged to a highest density that is occupied by the circles ($=\pi/\sqrt{12}$). Formula 4 below is mentioned also in Japanese Patent Application Laid-open No. H10-20539, and is a formula commonly used when calculating the theoretical coverage ratio.

$$\text{Theoretical coverage ratio X2 (area \%)}=3^{1/2}/(2\pi)\times(dt/da)\times(\rho t/\rho a)\times C\times 100 \qquad \text{Formula 4}$$

Where da: number-average particle diameter (D1) of silica fine particle (nm)

dt: weight-average particle diameter (D4) of toner (nm)

ρa: true specific gravity of silica fine particle ($g/cm^3$)

ρt: true specific gravity of toner ($g/cm^3$)

C: weight of silica fine particle/weight of toner (The subsequently described content of the silica fine particles in the toner is used as C.)

The physical significance of the diffusion index indicated by Formula 1 above is described below.

The diffusion index represents the divergence between the measured coverage ratio X1 and the theoretical coverage ratio X2. The degree of this divergence is thought to indicate how many fine particles of silica are stacked two or three layers in the vertical direction from the surface of the toner particles. The theoretical diffusion index for monodispersed particles is 1. In this state, the silica fine particles are in a closest packed state on the surface of the toner particles, and are all present in a single layer without any overlap. When the silica fine particle is present on the toner surface in a stacked state as aggregated secondary particles, a divergence arises between the measured coverage ratio and the theoretical coverage ratio, resulting in a smaller diffusion index. Hence, the diffusion index can also be said to indicate the amount of silica fine particle that exists as secondary particles.

In this invention, the diffusion index is preferably in the range indicated by above Formula 2, which range is thought to be larger than that of conventionally manufactured toners. A large diffusion index indicates that the amount of silica fine particle on the surface of the toner particles that is present as secondary particles is small, and that the amount present as primary particles is large. As mentioned above, the upper limit in the diffusion index is 1.

When the diffusion index is within the above range, the silica particles are uniformly distributed as primary particles on the toner surface, the adhesive forces between toner particles is lowered without a loss in the charging characteristics of the toner, and aggregation of the toner on the end face of the cleaning blade can be suppressed throughout use in a durability test. The mechanism by which the toner, owing to a large diffusion index, has difficulty aggregating even when compacted on the end face of the cleaning blade is thought by the inventors to be as follows.

When the toner is present in a high-pressure place such as on the end face of the cleaning blade, it is thought that the toner particles readily enter into an "interlocked" state so that the silica fine particles present on the surfaces thereof do not collide with one another. At this time, when many silica fine particles are present as secondary particles, the influence of interlocking becomes large, making it difficult to rapidly separate the toner particles, as a result of which toner aggregates readily arise.

Particularly in cases where the toner has deteriorated following use in a durability test, the silica fine particles which are present as primary particles are buried in the toner surface, which tends to lower the flowability of the toner. At that time, the influence of interlocking between silica fine particles which are not buried in the toner surface and are present as secondary particles becomes larger, presumably making the toner more difficult to separate. However, in the toner of the invention, because most of the silica fine particles are present as primary particles, even when the toner has deteriorated due to use in durability tests, interlocking between the toner particles does not readily arise. As a result, even in cases where toner collects and is subjected to pressure on the end face of the cleaning blade, it appears that the toner easily separates into individual particles and does not readily form into aggregates.

The boundary line for the diffusion index in the invention, within the range in the coverage ratio X1 of at least 50.0 area % and not more than 75 area %, is a function of the coverage ratio X1 as the variable. This function was empirically obtained from the phenomenon where, when the coverage ratio X1 and the diffusion index are obtained by varying, for example, the silica fine particles and the external addition conditions, the toner easily and fully disaggregates upon the application of pressure.

Figure 2:
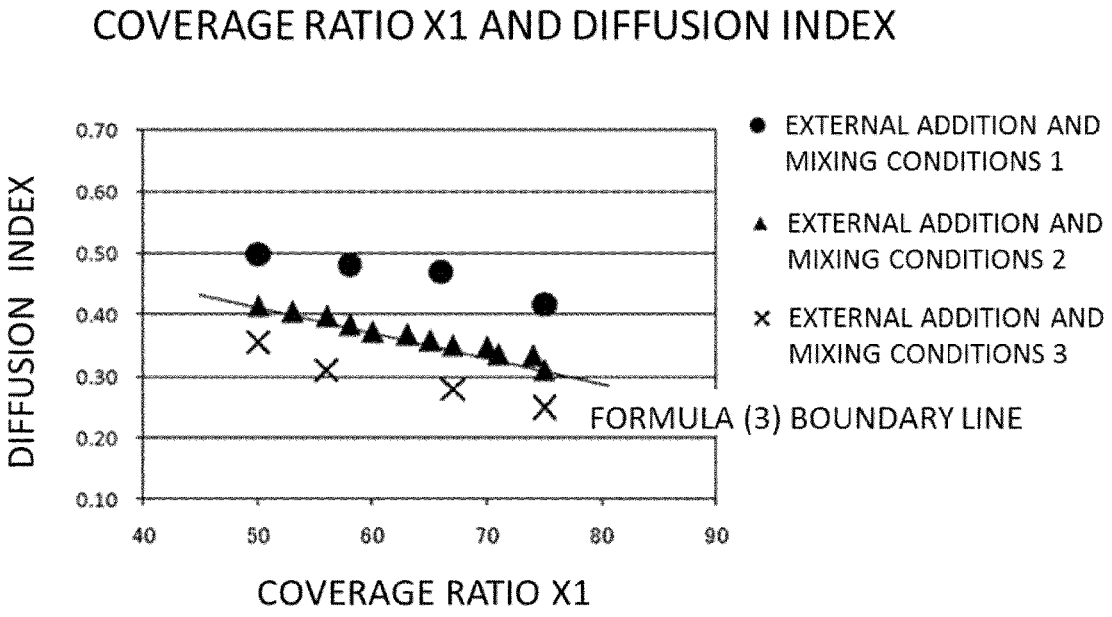
FIG. 2 is a diagram showing the boundary line of the diffusion index.

FIG. 2 is a graph which plots the relationship between the coverage ratio X1 and the diffusion index when toners having varying coverage rates X1 were manufactured by using three different external addition and mixing conditions and varying the amount of silica fine particle added. Of the toners plotted in this graph, the ease of toner disaggregation upon the application of pressure was found to improve sufficiently for the toner plotted in the region which satisfies Formula 2.

The reason why the diffusion index is dependent on the coverage ratio X1 is not well understood, although the inventors suspect this to be as follows. Because the ease of toner disaggregation upon the application of pressure improves, it is preferable for the amount of silica fine particles present as secondary particles to be small, although a not insubstantial influence by the coverage ratio X1 is also incurred. As the coverage ratio X1 increases, toner disaggregation gradually becomes easier, and so the permissible amount of silica fine particles present as secondary particles increases. In this way, the boundary line of the diffusion index is thought to become a function of the coverage ratio X1 as the variable. That is, a correlation exists between the coverage ratio X1 and the diffusion index, and it is preferable to control the diffusion index in accordance with the coverage ratio X1.

It is preferable for the inventive toner to have a total energy (mJ)/toner density (g/mL) value, as measured with a powder flowability measuring apparatus equipped with a rotary propeller-type blade, of at least 200 mJ/(g/mL) and not more than 300 mJ/(g/mL). This total energy (mJ)/toner density (g/mL) value (also referred to below simply as "TE/density") is an indicator representing the ease of toner disaggregation from a compacted state, and is a numerical expression of the physical resistance encountered by the blade when it enters a layer of compacted toner. A value of at least 200 mJ/(g/mL) and not more than 300 mJ/(g/mL) is preferred because the toner that has collected on the end face of the cleaning blade does not readily disaggregate even upon incurring pressure.

The above "TE/density" value can be adjusted within the above range by the overall control of such parameters as the toner shape and surface properties, and the type, amount and adhesion state of external additive particles.

Also, the "TE/density" value is strongly influenced by the average circularity of the toner. In order to adjust the "TE/density" value within the above range, high-circularity toner having an average circularity of at least 0.950 is preferred.

The inventive toner contains a colorant.

Colorants that may be advantageously used in the invention include those mentioned below.

Examples of organic pigments and organic dyes suitable as cyan colorants include copper phthalocyanine compounds and derivatives thereof, anthraquinone compounds, and basic dye lake compounds.

Examples of organic pigments and organic dyes suitable as magenta colorants include condensed azo compounds, diketopyrrolopyrrole compounds, anthraquinone and quinacridone compounds, basic dye lake compounds, naphthol compounds, benzimidazolone compounds, thioindigo compound and perylene compounds.

Examples of organic pigments and organic dyes suitable as yellow colorants include condensed azo compounds, isoindolinone compounds, anthraquinone compounds, azo metal complexes, methine compounds and allylamide compounds.

Exemplary black colorants include those obtained by color mixing to give a black color using carbon black, the above yellow colorants, the above magenta colorants and the above cyan colorants.

In cases where a colorant is used, colorant addition in an amount of at least 1 mass part and not more than 20 mass parts per 100 mass parts of the polymerizable monomer or binder resin is preferred.

The toner of the invention may also include magnetic body. In the invention, the magnetic body may play the role of a colorant as well.

The magnetic body used in the invention is composed primarily of black iron oxide or y-iron oxide, and may include such elements as phosphorus, cobalt, nickel, copper, magnesium, manganese and aluminum. The magnetic body is in the form of bodies having shapes which are, for example, polyhedral, octahedral, hexahedral, spherical, acicular or flake-like, although low anisotropy shapes such as polyhedral, octahedral, hexahedral and spherical shapes are preferable for increasing the image density. The content of magnetic body in the invention is preferably at least 50 mass parts and not more than 150 mass parts per 100 mass parts of the polymerizable monomer or binder resin.

The toner of the invention preferably includes a wax. The wax preferably contains a hydrocarbon wax. Examples of other waxes include amide waxes, higher fatty acids, long-chain alcohols, ketone waxes, ester waxes, and also derivatives of these such as graft compounds and block compounds. If necessary, two or more types of wax may be used in combination. Of these, in cases where a hydrocarbon wax obtained by the Fischer-Tropsch process is used, it is possible to maintain, particularly in contact development, a good developability over an extended period of time, and also to retain a good hot offset property. To the hydrocarbon wax, an antioxidant may also be added within a range that does not influence the toner charging performance.

The wax content per 100 mass parts of the binder resin is preferably at least 4.0 mass parts and not more than 30.0 mass parts, and more preferably at least 10.0 mass parts and not more than 25.0 mass parts.

In the toner of the invention, if necessary, a charge control agent may be included in the toner particles. By including a charge control agent, the charging characteristics can be stabilized and control of the optimal triboelectric charge quantity according to the development system is possible.

Use may be made of a known charge control agent, with a charge control agent that has a rapid charging speed and is capable of stably maintaining a constant charge quantity being especially preferred. Moreover, in cases where the toner particles are manufactured by a direct polymerization process, a charge control agent which has low polymerization inhibiting properties and which is substantially free of substances that are soluble in an aqueous medium is especially preferred.

The toner of the invention may include such a charge control agent singly or in combinations of two or more.

The content of the charge control agent per 100 mass parts of polymerizable monomer or binder resin is preferably at least 0.3 mass parts and not more than 10.0 mass parts, and is more preferably at least 0.5 mass parts and not more than 8.0 mass parts.

The toner of the invention includes toner particles and silica fine particles. Both what is referred to as dry silica or fumed silica, which are silicas produced by the vapor phase oxidation of silicon halides, and wet silica produced from water glass or the like may be used as the silica fine particles in the invention.

The amount of silica fine particle added in the invention is preferably at least 0.1 mass parts and not more than 5.0 mass parts per 100 mass parts of the toner particles. Setting the loadings of silica fine particle within the above range is desirable because a good flowability may be imparted to the toner and the fixing performance is not impaired.

The content of the silica fine particles can be determined by fluorescent X-ray analysis using a calibration curve prepared from standard samples.

A hydrophobic treatment is preferably carried out on the silica fine particles used in the present invention, and particularly preferred silica fine particles will have been hydrophobically treated to a hydrophobicity, as measured by the methanol titration test, of at least 40% and more preferably at least 50%.

The method for carrying out the hydrophobic treatment can be exemplified by methods in which treatment is carried out with, e.g., an organosilicon compound, a silicone oil, and so forth.

The organosilicon compound can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane.

The silicone oil can be exemplified by dimethylsilicone oil, methylphenylsilicone oil, α-methylstyrene-modified silicone oil, chlorophenyl silicone oil, and fluorine-modified silicone oil.

The silica fine particle used in the invention is preferably a base material silica that has been surface-treated with a silicone oil, and more preferably a base material silica that has been surface-treated with an organosilicon compound and a silicone oil, the reason being that the degree of hydrophobization can thereby be advantageously controlled.

Methods for treating base material silica with silicone oil include a method in which base material silica and a silicone oil are directly mixed using a mixer such as a Henschel mixer, and a method in which base material silica is sprayed with silicone oil. Alternatively, the method may be one in which a silicone oil is dissolved or dispersed in a suitable solvent, following which base material silica is added and mixed therewith, then the solvent is removed. To obtain good hydrophobic properties, the amount of silicone oil used to treat 100 mass parts of base material silica is preferably at least 1 mass part and not more than 40 mass parts, and more preferably at least 3 mass parts and not more than 35 mass parts.

In order for the base material silica used in the invention to confer the toner with good flowability, it preferably has a specific surface area, as measured by the BET method using nitrogen adsorption (BET specific surface area), of at least 130 $m^2/g$ and not more than 330 $m^2/g$. Within this range, the flowability imparted to the toner and the charging performance are more readily assured throughout use in a durability test. In this invention, the BET specific surface area of the base material silica is more preferably at least 200 $m^2/g$ and not more than 320 $m^2/g$. Measurement of the specific surface area measured by the BET method using nitrogen adsorption (BET specific surface area) is carried out in general accordance with JIS Z 8830 (2001). The TriStar 3000 surface area and porosimetry analyzer (available from Shimadzu Corporation), which employs constant volume gas adsorption as the method of measurement, is used as the measurement apparatus.

The number-average particle diameter (D1) of the primary particles in the base material silica in the present invention is preferably from at least 3 nm to not more than 50 nm and more preferably is from at least 5 nm to not more than 40 nm.

The weight-average particle diameter (D4) of the toner of the present invention is preferably from at least 6.0 μm to not more than 10.0 μm and more preferably is from at least 7.0 μm to not more than 9.0 μm.

Examples of methods for producing the toner of the present invention are provided below, but there is no intent to limit the production method to these.

The toner particles used in the invention may be manufactured by a dry process or by a wet process.

In cases where the toner particles are manufactured by a dry process, surface modification treatment is required in order to control the average circularity of toner particles produced by pulverization within the desired range. The surface modification apparatus used is exemplified by apparatuses which carry out impact blending within a high-speed airstream, such as the Surface Fusing system (Nippon Pneumatic Mfg. Co., Ltd.), the Nara Hybridization System (Nara Machinery Co., Ltd.), the Kryptron Cosmo System (Kawasaki Heavy Industries, Ltd.), or the Inomizer system (Hosokawa Micron Corporation); apparatuses which employ a dry mechanochemical process, such as the Mechanofusion system (Hosokawa Micron Corporation) or the Mechanomill (Okada Seiko Co., Ltd.); and apparatuses such as the Faculty (Hosokawa Micron Corporation).

In cases where the toner particles are manufactured by a wet process, suitable examples include methods of production in an aqueous medium, such as dispersion polymerization method, dissolution suspension method or suspension polymerization method. Production by suspension polymerization method or by association aggregation method is more preferred.

Suspension polymerization method refers to a process in which a polymerizable monomer composition is obtained by uniformly dissolving or dispersing the polymerizable monomer and the colorant, and also, where necessary, other additives such as a polymerization initiator, a crosslinking agent, a charge control agent and a wax. Using a suitable agitator, granulation is carried out by dispersing the resulting polymerizable monomer composition in an aqueous medium containing a dispersion stabilizer. In addition, the polymerizable monomer present within the granulated particles is polymerized, giving toner particles having a desired particle diameter. Toner particles obtained by this suspension polymerization process (also referred to below as "polymerized toner particles") are preferred because the individual toner particles have been substantially all rendered spherical in shape, as a result of which the particles satisfy the prescribed average circularity, in addition to which the distribution in the charge quantity is relatively uniform.

In the production of polymerized toner particles according to the invention, a known monomer may be used as the polymerizable monomer in the polymerizable monomer composition. Of such polymerizable monomers, styrene or a styrene derivative used by itself or in admixture with other polymerizable monomers is preferred from the standpoint of the developing characteristics and durability of the toner.

In working the invention, the polymerization initiator used in the above suspension polymerization process is preferably one which has a half-life at the time of the polymerization reaction of at least 0.5 hours and not more than 30.0 hours. The amount of polymerization initiator added is preferably at least 0.5 mass parts and not more than 20.0 mass parts per 100 mass parts of the polymerizable monomer.

Exemplary polymerization initiators include azo or diazo-type polymerization initiators, and peroxide-type polymerization initiators.

In the above suspension polymerization process, a crosslinking agent may be added at the time of the polymerization reaction. The amount of addition is preferably at least 0.1 mass parts and not more than 10.0 mass parts per 100 mass parts of the polymerizable monomer. A compound having primarily at least two polymerizable double bonds may be used as the crosslinking agent here. Illustrative examples include aromatic divinyl compounds, carboxylic acid esters having two double bonds, divinyl compounds, and compounds having three or more vinyl groups. These may be used singly or as mixtures of two or more thereof.

The production of toner particles by suspension polymerization method is described in detail below, although the invention is not limited in this regard. First, a polymerizable monomer composition, itself prepared by suitably adding together the above-described polymerizable monomer, colorant and the like, then uniformly dissolving or dispersing these ingredients with a disperser such as a homogenizer, a ball mill or an ultrasonic disperser, is dispersed in an aqueous medium containing a dispersion stabilizer and granulated. At this time, when a disperser such as a high-speed agitator or an ultrasonic disperser is used to achieve the desired toner particle size in a single step, the resulting toner particles have a sharp particle diameter. With regard to the timing of polymerization initiator addition, such addition may be carried out at the same time that other additives are added to the polymerizable monomer, or the initiator may be added just prior to suspension in the aqueous medium. Alternatively, it is also possible to add polymerization initiator that was dissolved in the polymerizable monomer or a solvent prior to the start of the polymerization reaction.

Following granulation, agitation to a degree that maintains the particle state and prevents the floating and settling of particles may be carried out using an ordinary agitator.

A known surfactant, organic dispersant or inorganic dispersant may be used as the dispersion stabilizer. Of these, the use of an inorganic dispersant is preferred because such dispersants do not readily give rise to harmful ultrafine powder, their steric hindrance provides dispersion stability, as a result of which the stability does not readily break down even when the reaction temperature is changed, in addition to which cleaning is easy and tends not to have an adverse impact on the toner. Illustrative examples of such inorganic dispersants include polyvalent metal salts of phosphoric acid, such as tricalcium phosphate, magnesium phosphate, aluminum phosphate, zinc phosphate and hydroxyapatite; carbonates such as calcium carbonate and magnesium carbonate; inorganic salts such as calcium metasilicate, calcium sulfate and barium sulfate; and inorganic compounds such as calcium hydroxide, magnesium hydroxide and aluminum hydroxide.

These inorganic dispersants may be used in an amount of at least 0.20 mass parts and not more than 20.00 mass parts per 100 mass parts of the polymerizable monomer. The above dispersion stabilizer may be used singly or a plurality of dispersion stabilizers may be used in combination. In addition, concomitant use may be made of at least 0.0001 mass parts and not more than 0.1000 mass parts of a surfactant per 100 mass parts of the polymerizable monomer.

In the polymerization reaction on the above polymerizable monomer, the polymerization temperature is set to at least 40° C., and generally to at least 50° C., but not more than 90° C.

After polymerization of the polymerizable monomer is complete, toner particles are obtained by filtration, washing and drying of the resulting polymer particles by known methods. The silica fine particles are externally added to and mixed with these toner particles, and thereby deposited on the surface of the toner particles, giving the toner of the invention.

It is also possible to include a classifying step in the production process (prior to mixing of the inorganic fine particles), and thereby cut out coarse powder and fine powder included in the toner particles.

In addition to the above silica fine particle, particles having a primary particle number-average particle diameter (D1) of at least 80 nm and not more than 3 μm may be added to the toner of the invention. For example, lubricants such as fluororesin powder, zinc stearate powder, and polyvinylidene fluoride powder; abrasives such as cerium oxide powder, silicon carbide powder and strontium titanate powder; and spacer particles such as silica may be used in small amounts of a degree that does not adversely affect the advantageous effects of the invention.

The production of toner particles by an association aggregation method is described in detail below, although the invention is not limited in this regard.

First, particulate polymer is produced by a known method. Examples of methods for producing particulate vinyl polymer include emulsion polymerization and soap-free emulsion polymerization. Examples of methods for producing particulate polyester-type polymer include a method in which polyester is dissolved in a suitable solvent and neutralized, then is phase inversion emulsified, and a method in which polyester is dissolved in a suitable solvent, then is dispersed in an aqueous phase using a disperser. An optional surfactant may be also be used at the time of dispersion. The polyester may be obtained by the polycondensation of an alcohol component and a carboxylic acid component in the presence of an ester catalyst and at a temperature of from 150 to 280° C.

Next, a mixture of the aqueous suspension of particulate polymer and an aqueous suspension of particulate colorant has added thereto and mixed therewith a pH adjustor, a flocculant, a stabilizer and the like, following which an aggregate of the fine particles is formed with the suitable application of mechanical power or the like and heating. If necessary, particulate wax and particulate charge control agent may be co-aggregated at the same time or in a separate step. Also, the colorant, wax and charge control agent may be seed polymerized beforehand.

The stabilizer is exemplified primarily by polar surfactants alone and aqueous media containing polar surfactants. For example, in cases where the polar surfactant included in the above-described aqueous dispersion is anionic, a cationic stabilizer may be selected. The addition and mixture of the flocculant and the like is preferably carried out at a temperature which is at or below the glass transition point of the polymer included in the mixture. By carrying out such mixture under these temperature conditions, aggregation proceeds in a stable state. The above mixture may be carried out using a known mixing apparatus, homogenizer, mixer or the like. The average particle diameter of the aggregate that forms here is not particularly limited, and is typically controlled so as to become about the same as the average particle diameter of the desired toner. Such control may be easily carried out by, for example, suitably setting and changing the temperature and the stirring and mixing conditions.

The heating temperature should be at least the glass transition point temperature of the polymer included in the aggregate of fine particles. Also, heating can be carried out using a known heating apparatus or vessel. The heating time may be short if the heating temperature is high, although a long time will be needed if the heating temperature is low. After heating, the resulting polymer particles are filtered, washed and dried by known methods, yielding toner particles.

It is also possible to produce the toner particles used in the invention by carrying out surface treatment with a hot air current or some other surface modification treatment on toner particles produced by an ordinary pulverization method.

An example of such a production method is described below. First, in a starting material mixing step, given amounts of at least a binder resin, a magnetic body and/or a colorant are weighed out, then compounded, and mixed using a mixing apparatus. In addition, the mixed toner starting materials are melt-kneaded, thereby melting the resins and dispersing the magnetic body and/or the colorant, etc. therein. In this melt-kneading step, use may be made of a batch-type kneading apparatus such as a pressurizing kneader or a Banbury mixer, or of a continuous kneading apparatus. After melt kneading, the resin composition obtained by melt-kneading the toner starting materials is rolled in a two-roll mill or the like, and is cooled by passing through a cooling step such as water cooling. The cooled resin composition thus obtained is then pulverized in a pulverizing step to the desired particle diameter, giving a pulverized product. Next, surface treatment with a hot air current is carried out using a surface treatment apparatus, thereby giving toner particles. The method of surface treatment with a hot air current is preferably one in which the toner particles are ejected by spraying from a high-pressure air feed nozzle, and the ejected toner particles are exposed within a hot air current, thereby treating the surface of the toner particles. The temperature of the hot air current is preferably in a range of at least 100° C. and not more than 450° C.

Figure 4:
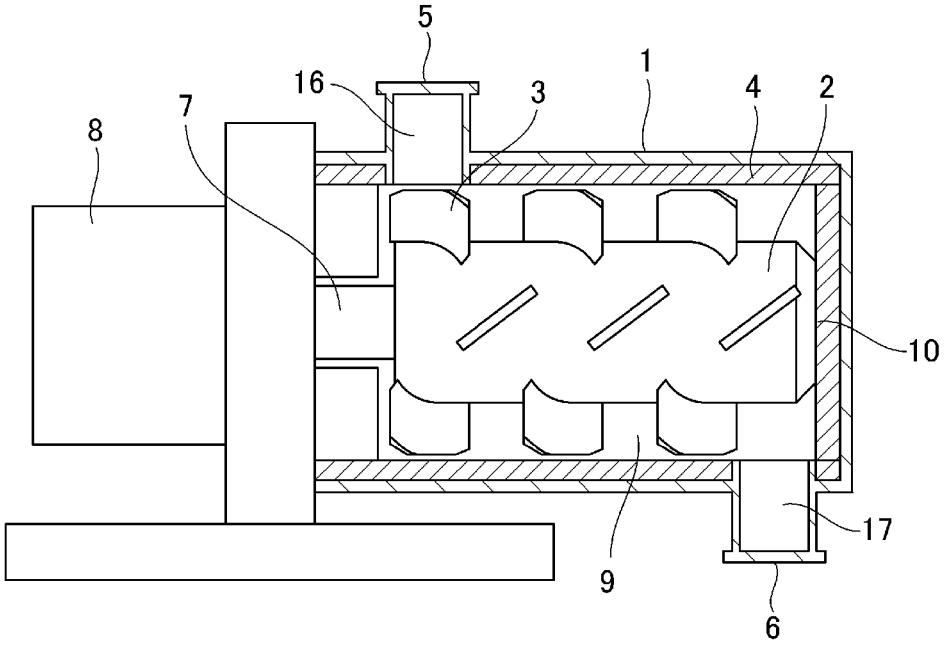
FIG. 4 is a schematic diagram showing an example of a mixing process apparatus which can be used in the external addition and mixing of fine inorganic particles.

A known mixing process apparatus, e.g., the mixers described above, can be used for the external addition and mixing of the silica fine particles; however, an apparatus as shown in FIG. 4 is preferred from the standpoint of enabling facile control of the coverage ratio X1 and the diffusion index.

FIG. 4 is a schematic diagram that shows an example of a mixing process apparatus that can be used to carry out the external addition and mixing of the silica fine particles used by the present invention.

Because this mixing process apparatus is constructed in such a way that shear acts upon the toner particles and the silica fine particles in an area of narrow clearance, the silica fine particles can be deposited on the surfaces of the toner particles while being broken down from secondary particles into primary particles.

Furthermore, as described below, the coverage ratio X1 or diffusion index are easily controlled into the ranges preferred for the present invention because circulation of the toner particles and silica fine particles in the axial direction of the rotating member is facilitated and because a thorough and uniform mixing is facilitated prior to the development of fixing.

Figure 5:
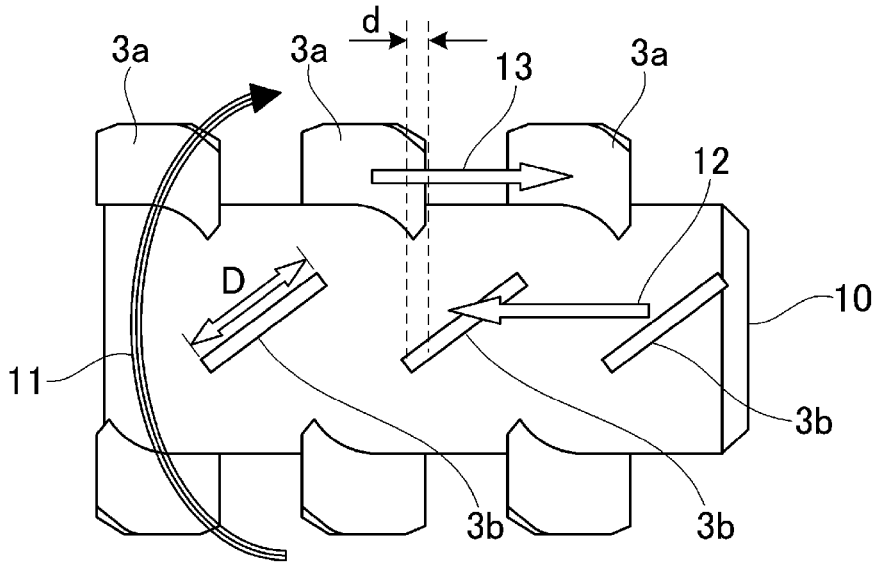
FIG. 5 is a schematic diagram shows an example of the construction of stirring members used in a mixing process apparatus.

On the other hand, FIG. 5 is a schematic diagram that shows an example of the structure of the stirring member used in the aforementioned mixing process apparatus.

The external addition and mixing process for the silica fine particles is described below using FIGS. 4 and 5.

This mixing process apparatus that carries out external addition and mixing of the silica fine particles has a rotating member 2, on the surface of which at least a plurality of stirring members 3 are disposed; a drive member 8, which drives the rotation of the rotating member; and a main casing 1, which is disposed to have a gap with the stirring members 3.

To uniformly impart shear to the toner particles and thereby facilitate deposition of the silica fine particles on the surface of the toner particles while breaking down the secondary particles of silica fine particles into primary particles, it is important for the clearance between the inner peripheral portion of the main casing 1 and the stirring member 3 to be kept constant and very small.

Also, in this apparatus, the diameter of the inner peripheral portion of the main casing 1 is not more than twice the diameter of the outer peripheral portion of the rotating member 2. FIG. 4 shows a case in which the diameter of the inner peripheral portion of the main casing 1 is 1.7 times the diameter of the outer peripheral portion of the rotating member 2 (i.e., the diameter of the cylindrical body, excluding the stirring members 3 from the rotating member 2). By having the diameter of the inner peripheral portion of the main casing 1 be no more than twice the diameter of the outer peripheral portion of the rotating member 2, the processing space where forces act upon the toner particles is suitably restricted, allowing sufficient impact forces to be applied to the silica fine particles which are present as secondary particles.

It is important to adjust the above clearance according to the size of the main casing. Setting the clearance to at least about 1% and not more than about 5% the diameter of the inner peripheral portion of the main casing 1 is important for applying sufficient shear to the silica fine particles. Specifically, when the diameter of the inner peripheral portion of the main casing 1 is about 130 mm, the clearance should be set to at least about 2 mm and not more than about 5 mm. When the diameter of the inner peripheral portion of the main casing 1 is about 800 mm, the clearance should be set to at least about 10 mm and not more than about 30 mm.

In the process of the external addition and mixing of the silica fine particles in the present invention, mixing and external addition of the silica fine particles to the toner particle surface are performed using the mixing process apparatus by rotating the rotating member 2 by the drive member 8 and stirring and mixing the toner particles and silica fine particles that have been introduced into the mixing process apparatus.

As shown in FIG. 5, at least some of the plurality of stirring members 3 are shaped as forward stirring members 3*a* such that, with rotation of the rotating member 2, the toner particles and silica fine particles are transported forward in the axial direction of the rotating member 2. In addition, at least some of the plurality of stirring members 3 are shaped as backward stirring members 3*b* such that, with rotation of the rotating member 2, the toner particles and silica fine particles are transported backward in the axial direction of the rotating member 2.

Here, when the raw material inlet port 5 and the product discharge port 6 are disposed at the two ends of the main casing 1, as in FIG. 4, the direction toward the product discharge port 6 from the raw material inlet port 5 (the direction to the right in FIG. 4) is the "forward direction".

That is, as shown in FIG. 5, the surfaces of the forward stirring members 3*a* are inclined so as to transport toner particles in the forward direction (13), and the surfaces of the backward stirring members 3*b* are inclined so as to transport toner particles and silica fine particles in the backward direction (12).

By doing this, the external addition of the silica fine particles to the surface of the toner particles and mixing are carried out while repeatedly performing transport in the "forward direction" (13) and transport in the "back direction" (12).

The stirring members 3*a* and 3*b* are formed as sets, each set being composed of a plurality of blades, which are arranged at intervals in the circumferential direction of the rotating member 2. In the example shown in FIG. 5, the stirring members 3*a* and 3*b* are formed as sets of two members situated at mutual intervals of 180 degrees on the rotating member 2, although a larger number of blades may similarly form a set, such as three blades at intervals of 120 degrees or four blades at intervals of 90 degrees.

In the example shown in FIG. 5, a total of twelve stirring members 3*a*, 3*b* are formed at an equal interval.

In FIG. 5, D represents the width of a stirring member and d indicates the distance that represents the overlapping portion of a stirring member. From the standpoint of efficiently transporting the toner particles and the silica fine particles in the forward and reverse directions, it is preferable for the width D to be at least about 20% but not more than about 30% of the length of the rotating member 2 in FIG. 5. FIG. 5 shows an example in which this is 23%. In addition, it is preferable for the stirring members 3*a* and 3*b* to have some degree of mutual overlap d; specifically, when a line is extended vertically from one end of a stirring member 3*a*, it is preferable for there to be some degree of overlap d with a stirring member 3*b*. This makes it possible for shear to act efficiently upon the silica fine particles that are present as secondary particles. Having the radio d/D be at least 10% but not more than 30% is preferable for applying shear.

In addition to the shape shown in FIG. 5, the blade shape may be—insofar as the toner particles can be transported in the forward direction and back direction and the clearance is retained—a shape having a curved surface or a paddle structure in which a distal blade element is connected to the rotating member 2 by a rod-shaped arm.

The present invention will be described in additional detail herebelow with reference to the schematic diagrams of the apparatus shown in FIGS. 4 and 5.

The apparatus shown in FIG. 4 has a rotating member 2, which has at least a plurality of stirring members 3 disposed on its surface; a drive member 8 that drives the rotation of the rotating member 2; a main casing 1, which is disposed forming a gap with the stirring members 3; and a jacket 4, in which a heat transfer medium can flow and which resides on the inside of the main casing 1 and at the end surface 10 of the rotating member.

The apparatus shown in FIG. 4 also has both a raw material inlet port 5 formed at the top of the main casing 1 for introducing the toner particles and the silica fine particles, and a product discharge port 6 formed at the bottom of the main casing 1 for discharging, from the main casing 1 to the exterior, toner which has been subjected to external addition and mixing process. The apparatus shown in FIG. 4 additionally has a raw material inlet port inner piece 16 inserted into the raw material inlet port 5, and a product discharging port inner piece 17 inserted into the product discharge port 6.

In the invention, first, the raw material inlet port inner piece 16 is removed from the raw material inlet port 5, and toner particles are charged into a processing space 9 from the raw material inlet port 5. Next, silica fine particles are charged into the processing space 9 from the raw material inlet port 5, and the raw material inlet port inner piece 16 is inserted. The rotating member 2 is then rotated (in the direction of rotation 11) by a drive member 8, thereby subjecting the charged material to external addition and mixing process while being agitated and mixed by the plurality of stirring members 3 provided on the surface of the rotating member 2.

The charging sequence may begin with charging of the silica fine particles from the raw material inlet port 5, and follow with charging of the toner particles from the raw material inlet port 5. Alternatively, the toner particles and the silica fine particles may be mixed together beforehand with a mixing apparatus such as Henschel mixer, following which the mixture may be charged from the raw material inlet port 5 of the apparatus shown in FIG. 4.

More specifically, in terms of the external addition and mixing process conditions, controlling the power of the drive member 8 to at least 0.2 W/g and not more than 2.0 W/g is preferable for obtaining the coverage ratio X1 and the diffusion index stipulated in this invention. Controlling the power of the drive member 8 to at least 0.6 W/g and not more than 1.6 W/g is more preferred.

When the power is lower than 0.2 W/g, it is difficult for a high coverage ratio X1 to be achieved, and the diffusion index has a tendency to be too low. On the other hand, when the power is higher than 2.0 W/g, the diffusion index becomes high and there is a tendency for too much silica fine particles to be embedded on the toner particles.

The processing time, although not particularly limited, is preferably at least 3 minutes and not more than 10 minutes. At a processing time shorter than 3 minutes, the coverage ratio X1 and the diffusion index have a tendency to become low.

The rotational speed of the blades during external addition and mixing is not particularly limited. However, in an apparatus where the volume of the processing space 9 shown in FIG. 4 is $2.0\times10^{-3}$ $m^3$, when the stirring members 3 are of the shape shown in FIG. 5, it is preferable for the blades to have a rotational speed which is at least 800 rpm and not more than 3,000 rpm. At a rotational speed of at least 800 rpm and not more than 3,000 rpm, the coverage ratio X1 and the diffusion index stipulated in this invention are easily obtained.

Also, in this invention, an especially preferred treatment method is to provide a premixing step before the external addition and mixing process operation. By adding a premixing step, the silica fine particles are uniformly dispersed to a high degree on the surface of the toner particles, making it easy to achieve a high coverage ratio X1 and also a high diffusion index.

More specifically, in terms of the premixing treatment conditions, setting the power of the drive member 8 to at least 0.06 W/g and not more than 0.20 W/g, and setting the processing time to at least 0.5 minutes and not more than 1.5 minutes, is preferred. If the premixing treatment conditions are set to a load power which is lower than 0.06 W/g or a processing time which is shorter than 0.5 minutes, mixing that is sufficiently uniform for premixing is difficult to achieve. On the other hand, if the premixing treatment conditions are set to a load powder which is higher than 0.20 W/g or a processing time which is longer than 1.5 minutes, the silica fine particles may end up sticking to the surface of the toner particles before sufficiently uniform mixing has been carried out.

With regard to the rotational speed of the stirring members in premixing treatment, in an apparatus where the volume of the processing space 9 shown in FIG. 4 is $2.0\times10^{-3}$ $m^3$, when the stirring members 3 are of the shape shown in FIG. 5, it is preferable for the blades to have a rotational speed which is at least 50 rpm and not more than 500 rpm. At a rotational speed of at least 50 rpm and not more than 500 rpm, the coverage ratio X1 and the diffusion index stipulated in this invention are easily obtained.

Following the completion of external addition and mixing process, the inner piece 17 within the product discharging port 6 is removed, and toner is discharged from the product discharge port 6 by having the drive member 8 rotate the rotational member 2. If necessary, coarse particles and the like are separated off from the resulting toner with a sieve such as a circular oscillating sieve, thereby giving the final toner.

Next, an example of an image-forming apparatus capable of advantageously using the toner of the invention is described in detail while referring to FIG. 1. FIG. 1 shows an electrostatic latent image bearing member (also referred to below as a "photoreceptor") 100 and, provided at the periphery thereof, a charging member (charging roller) 117, a developing device 140 having a toner-carrying member 102, a transfer member (transfer charging roller) 114, a cleaner receptacle 116, a fixing unit 126 and a pickup roller 124. The electrostatic latent image bearing member 100 is electrostatically charged by the charging roller 117. Next, exposure is carried out by using a laser generator 121 to shine laser light onto the electrostatic latent image bearing member 100, resulting in the formation of an electrostatic latent image corresponding to the target image. The electrostatic latent image on the electrostatic latent image bearing member 100 is developed with a single-component toner by the developing device 140, giving a toner image. The toner image is then transferred onto a transfer material by the transfer roller 114 which has been contacted with the electrostatic latent image bearing member through the transfer material. The transfer material on which the toner image has been placed is transported to the fixing unit 126, where the toner image is fixed onto the transfer material. The toner that remains on the electrostatic latent image bearing member is scraped off with a cleaning blade and held in the cleaner receptacle 116.

It is preferable for the cleaning blade provided in the above cleaner receptacle to have a linear pressure against the surface of the electrostatic latent image bearing member of at least 300 mN/cm and not more than 1,200 mN/cm. Within this range, the untransferred toner can be stably scraped off without excessively scraping the surface of the electrostatic latent image bearing member. Moreover, at a linear pressure in this range, friction with the surface of the electrostatic latent image bearing member is held down, which is desirable because this lowers the energy used to drive the electrostatic latent mage bearing member.

Also, when the hardness at both ends in the lengthwise direction on the end face of the cleaning blade, as measured with a microhardness tester for rubber, is at least 72° and not more than 90°, and the hardness at the entire area of lateral side and at the center in the lengthwise direction on the end face are at least 55° and not more than 70°, the generation of localized vibration is easily suppressed.

The methods for measuring the various properties related to the toner according to the present invention are described below.

Method of Assaying Silica Fine Particle (1) Determination of Silica Fine Particle Content in Toner (Standard Addition Method):

Toner (3 g) is added to a 30 mm diameter aluminum ring, and a pellet is produced under an applied pressure of 10 metric tons. The intensity of silicon (Si) is measured (Si Intensity—1) by wavelength-dispersive fluorescent X-ray analysis (XRF). The measurement conditions should be conditions that have been optimized in the XRF unit used, although a series of intensity measurements must all be carried out under the same conditions. Silica fine particle composed of primary particles having a number-average particle diameter of 12 nm is added in an amount of 1.0 wt % with respect to the toner, and mixed using a coffee mill.

After mixing, pelletization is carried out in the same way as described above, following which the intensity of Si is determined as described above (Si Intensity—2). In addition, the Si intensities for samples obtained by carrying out similar operations to add and mix, with respect to the toner, 2.0 wt % or 3.0 wt % of silica fine particles are also determined (Si Intensity—3, Si Intensity—4). Using Si Intensity—1 to Si Intensity—4, the silica content (wt %) in the toner is calculated by the standard addition method.

(2) Separation of Silica Fine Particles from Toner:

If the toner contains a magnetic body, determination of the silica fine particles is carried out via the following step.

Five grams of toner is weighed out into a 200 mL plastic cup with cap using a precision scale, following which 100 mL of methanol is added and dispersion is effected for 5 minutes in an ultrasonic disperser. The toner is attracted with a neodymium magnet, and the supernatant is discarded. The operations of dispersing in methanol and discarding supernatant are repeated three times. Then, 100 mL of 10% NaOH and several drops of Contaminon N (a 10 wt % aqueous solution of a neutral (pH 7) cleanser for cleaning precision analyzers which is composed of a nonionic surfactant, an anionic surfactant and an organic builder; available from Wako Pure Chemical Industries, Ltd.) are added and lightly mixed, following which the mixture is left at rest for 24 hours. Next, separation is again carried out using a neodymium magnet. Distilled water is repeatedly poured in at this time so that NaOH does not remain behind. The recovered particles are thoroughly dried with a vacuum drier, giving Particle A. The added silica fine particle is dissolved and removed by the foregoing operations.

(3) Measurement of Si Intensity in Particle A:

Three grams of Particle A is placed in a 30 mm diameter aluminum ring and a pellet is formed under a pressure of 10 metric tons. The Si intensity (Si Intensity—5) is determined by wavelength-dispersive X-ray analysis (XRF) on the pellet. The silica content (wt %) within Particle A is calculated using Si Intensity—5 and also the Si Intensity—1 to Si Intensity—4 values used to determine the silica content in the toner.

The amount of externally added silica fine particle is calculated by substituting the respective assay values in the following formula.

Amount of externally added silica fine particle (wt %)=silica content (wt %) in toner−silica content (wt %) in Particle A Method of Measuring Coverage Ratio X1

The coverage ratio X1 by the silica fine particles on the toner surface is calculated as follows.

Elemental analysis of the toner surface is carried out using the following measurement apparatus under the conditions indicated.

Measurement apparatus: Quantum 2000 (trade name, from Ulvac-Phi, Inc.)

X-ray source: Monochrome Al Kα

X-ray setting: 100 μm diameter (25 W (15 KV))

Photoelectron take-off angle: 45°

Neutralization conditions: joint use of neutralization gun and ion gun

Analysis region: 300×200 μm
Pass energy: 58.70 eV
Step size: 1.25 eV
Analytic software: Multipak (from PHI)

Here, the C 1c (B.E. 280 to 295 eV) O 1s (B.E. 525 to 540 eV) and Si 2p (B.E. 95 to 113 eV) peaks were used to calculate the assay value for elemental Si. The elemental Si assay value obtained here is labeled "Y1."

Next, as in the above-described elemental analysis at the toner surface, elemental analysis of the silica fine particle is carried out, and the assay value for elemental Si obtained here is labeled "Y2."

$$\text{Coverage ratio } X1 \text{ (area \%)} = Y1/Y2 \times 100$$

To improve the accuracy of this measurement, it is preferable to carry out the measurement of Y1 and Y2 two or more times.

When determining the assay value Y2, measurement is best carried out using the silica fine particle used in external addition, if it can be acquired.

In cases where silica fine particle that has separated from the toner surface is used as the measurement sample, separation of the silica fine particle from the toner particles is carried out by the following procedure.

1) In the Case of a Magnetic Toner:

First, a dispersion medium is created by adding 6 mL of Contaminon N (a 10 wt % aqueous solution of a neutral (pH 7) cleanser for cleaning precision analyzers which is composed of a nonionic surfactant, an anionic surfactant and an organic builder; available from Wako Pure Chemical Industries, Ltd.) to 100 mL of ion-exchanged water. Five grams of toner is then added to this dispersion medium and dispersion is carried out for 5 minutes in an ultrasonic disperser. Next, this dispersion is set in a KM Shaker (model V. SX, from Iwaki Industry Co., Ltd.), and reciprocally shaken for 20 minutes at 350 rpm. The supernatant is then gathered using a neodymium magnet to hold back the toner particles. This supernatant is dried, thereby collecting the silica fine particles. In cases where a sufficient amount of silica fine particles cannot thus be collected, these operations are repeatedly carried out.

When external additives other than silica fine particle are added, those external additives other than silica fine particle can also be collected by this method. In such cases, it is best to separate off the silica fine particle such as by centrifugal separation from the external additives that have been collected.

2) In the Case of a Non-Magnetic Toner:

A sucrose syrup is prepared by adding 160 g of sucrose (from Kishida Kagaku) to 100 mL of ion-exchanged water and dissolving the sugar on a hot water bath. A dispersion is prepared by placing 31 g of the sucrose syrup and 6 mL of Contaminon N in a centrifuge tube. One gram of toner is added to this dispersion, and clumps of toner are broken up with a spatula or the like.

The centrifuge tube is reciprocally shaken for 20 minutes at 350 rpm on the above-described shaker. After shaking, the solution is transferred to a 50 mL glass tube for a Swing Rotor centrifuge and centrifuged at 3,500 rpm for 30 minutes on the centrifuge. In the glass tube following centrifugation, toner is present in the uppermost layer and silica fine particle is present on the aqueous solution side serving as the bottom layer. The aqueous solution serving as the bottom layer is gathered and subjected to centrifugation, thereby separating the sucrose and the silica fine particle, and the silica fine particle is collected. After repeatedly carrying out centrifugation and thoroughly carrying out separation as needed, the dispersion is dried and the silica fine particle is collected.

As in the case of magnetic toner, if external additives other than silica fine particle have been added, the external additives other than silica fine particle also are collected. The silica fine particle is thus separated off by centrifugal separation or the like from the external additives that have been collected.

Method of Measuring Weight-Average Particle Diameter (D4) of Toner

The weight-average particle diameter (D4) of the toner is calculated as follows (calculation is carried out in the same way in the case of toner particles as well). The measurement apparatus is a precision analyzer for particle characterization based on the pore electrical resistance method and equipped with a 100 μm aperture tube (Coulter Counter Multisizer 3®, manufactured by Beckman Coulter). Dedicated software (Beckman Coulter Multisizer 3, Version 3.51 (from Beckman Coulter)) furnished with the device is used for setting the measurement conditions and analyzing the measurement data. Measurement is carried out with the following number of effective measurement channels: 25,000.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

From the "Changing Standard Operating Mode (SOM)" screen of the software, select the Control Mode tab and set the Total Count to 50,000 particles, the Number of Runs to 1, and the Kd value to the value obtained using "Standard particle 10.0 μm" (from Beckman Coulter). Pressing the "Threshold/Noise Level Measuring Button" automatically sets the threshold and noise levels. Set the Current to 1,600 μA, the Gain to 2, and the Electrolyte to ISOTON II, and place a check mark by "Flush aperture tube following measurement."

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Place about 200 mL of the above aqueous electrolyte solution in a 250 mL glass round-bottomed beaker for the Multisizer 3, set the beaker on the sample stand, and carry out stirring counterclockwise with a stirrer rod at a speed of 24 rotations per second. Then use the "Aperture Flush" function in the software to remove debris and air bubbles from the aperture tube.

(2) Place about 30 mL of the aqueous electrolyte solution in a 100 mL glass flat-bottomed beaker. Add about 0.3 mL of a dilution obtained by diluting the dispersant "Contaminon N" (a 10 wt % aqueous solution of a neutral (pH 7) cleanser for cleaning precision analyzers which is composed of a nonionic surfactant, a anionic surfactant and an organic builder; available from Wako Pure Chemical Industries, Ltd.) about 3-fold by weight with ion-exchanged water to the electrolyte solution.

(3) Prepare for use a Tetora 150 ultrasonic dispersion system (from Nikkaki Bios) having an electrical output of 120 W and equipped with two oscillators which oscillate at 50 kHz and are configured at a phase offset of 180 degrees. Place about 3.3 L of ion-exchanged water in the water tank of the system, and add about 2 mL of Contaminon N to the tank.

(4) Set the beaker prepared in (2) above in a beaker-securing hole of the ultrasonic dispersion system, and operate the system. Adjust the beaker height position so as to maximize the resonance state of the aqueous electrolyte solution liquid level within the beaker.

(5) Subject the aqueous electrolyte solution within the beaker in (4) above to ultrasonic irradiation while adding about 10 mg of toner a little at a time to the solution. Then continue ultrasonic dispersion treatment for 60 seconds while suitably regulating operation so that the water temperature in the tank is at least 10° C. but not above 40° C.

(6) Using a pipette, the dispersed toner-containing aqueous electrolyte solution prepared in (5) is dripped into the roundbottom beaker set in the sample stand as described in (1) with adjustment to provide a measurement concentration of about 5%.

Next, continue measurement until the number of measured particles reaches 50,000.

(7) Carry out analysis of the measurement data using the dedicated software provided with the Multisizer 3 system, and compute the weight-average particle diameter (D4). When "Graph/Vol %" is selected in the software program, the "average size" in the "Analysis/Volume Statistics (arithmetic average)" pane is the weight-average particle diameter (D4).

Method of Measuring Number-Average Particle Diameter of Primary Particles of Silica Fine Particle The number-average particle diameter of primary particles of silica fine particle is calculated from an image of silica fine particle on a toner surface taken with a Hitachi S-4800 ultra-high resolution field-emission scanning electron microscope (Hitachi High-Technologies Corporation). The S-4800 image-capturing conditions are as follows.

(1) Sample Preparation:

Conductive paste is spread lightly over the microscope stage (an aluminum stage measuring 15 mm×6 mm), and toner is blown thereon. Air is then blown over the toner, removing excess toner from the stage and thoroughly drying the paste. Next, the stage is set in a sample holder and the stage height is adjusted to 36 mm with a sample height gauge.

(2) Setting the S-4800 Observation Conditions:

The number-average particle diameter of primary particles of the silica fine particle is calculated using an image obtained by backscattered electron image observation with the S-4800. Compared with a secondary electron image, in a backscattered electron image, less charge-up of the silica fine particle occurs, as a result of which the particle diameter of the silica fine particle can be precisely measured.

Pour liquid nitrogen to the point of overflowing into an anti-contamination trap mounted on the S-4800 housing, and let the microscope stand for 30 minutes. Next, boot up the PC-SEM software for the S-4800, and carry out flushing (cleaning of the FE chip serving as the electron source). Next, click on the acceleration voltage indicator portion of the control panel on the screen, press the "Flushing" button, and open the Flushing Execution dialog box. After verifying that the flushing strength is 2, execute flushing. Verify that the emission current due to flushing is from 20 to 40 μA. Insert the sample holder in the sample chamber on the S-4800 housing. Press "home" on the control panel, and move the sample holder to the examination position.

Click the acceleration voltage indicator and open the HV selection dialog box, then set the acceleration voltage to "0.8 kV" and the emission current to "20 μA." Within the "Basic" tab on the operation panel, set the signal selection to "SE," select "Up (U)" and "+BSE" as the SE detectors and, in the selection box to the right of "+BSE," select "L.A. 100," thereby setting the microscope in the mode for examination in a backscattered electron image. Also within the "Basic" tab in the operation panel, set the probe current in the Electron Optics Conditions block to "normal," the focus mode to "UHR," and WD to "3.0 mm." Apply the acceleration voltage by pressing the "ON" button of the acceleration voltage indicator on the control panel.

(3) Calculation of Number-Average Particle Diameter (D1) (Referred to Above as "Da") of Silica Fine Particle:

Drag the magnification indicator on the control panel and set the magnification to 100,000× (100 k). Rotate the "Coarse" focus knob on the operation panel and, once the image is more or less in focus, carry out adjustment of the aperture alignment. Click on "Align" in the control panel to display the alignment dialog box, and select "Beam." Rotate the "Stigma/Alignment" knobs (X, Y) on the operation panel so as to move the displayed beam to the center of the concentric circuit, then select [Aperture] and turn the "Stigma/Alignment" knobs (X, Y) one at a time and adjust them so as to stop or minimize image movement. Close the aperture dialog box and use Autofocus to adjust the focus. Repeat this operation two more times to adjust the focus.

Next, measure the particle diameters for at least 300 silica fine particles on the toner surface, and determine the average particle diameter. Here, because some of the silica fine particle is present as aggregate, the number-average particle diameter (D1) (da) of primary particles of the silica fine particle is obtained by determining the maximum diameters of particles that can be confirmed to be primary particles, and calculating the arithmetic mean of the maximum diameters thus obtained.

Method of Measuring True Specific Gravities of Toner and Silica Fine Particle

The true specific gravities of the toner and the silica fine particle were measured with a dry automated densitometer-autopycnometer (from Yuasa Ionics). The measurement conditions were as follows.

Cell: SM cell (10 mL)

Sample weight: about 2.0 g (toner), 0.05 g (silica fine particle)

This measurement method measures the true specific gravity of solids and liquids based on the vapor-phase substitution method. As with the liquid-phase substitution method, this is based on the Archimedean principle. However, because gas (argon gas) is used as the substitution medium, the precision for very small pores is high.

Method of Measuring Average Circularity of Toner

The average circularity of the toner is measured with the "FPIA-3000" (Sysmex Corporation), a flow-type particle image analyzer, using the measurement and analysis conditions from the calibration process.

The method of measurement is as follows. First, about 20 mL of ion-exchanged water from which solid impurities have been removed is placed in a glass vessel. Next, about 0.2 mL of a dilution prepared by diluting Contaminon N (a 10 wt % aqueous solution of a neutral (pH 7) cleanser for cleaning precision analyzers which is composed of a nonionic surfactant, an anionic surfactant and an organic builder; available from Wako Pure Chemical Industries, Ltd.) with an approximately 3-fold weight of ion-exchanged water is added to this as the dispersant. About 0.02 g of the measurement sample is then added and dispersion treatment is carried out for 2 minutes using an ultrasonic disperser, thereby forming a dispersion for measurement. The dispersion is suitably cooled at this time to a temperature of at least 10° C. and not more than 40° C. Using a desktop ultrasonic cleaner/disperser (e.g., VS-150 from Velvo-Clear) having a oscillation frequency of 50 kHz and an electrical output of 150 W as the ultrasonic disperser, a given amount of ion-exchanged water was placed in the water tank and about 2 mL of Contaminon N was added to this tank.

Measurement was carried out using a flow-type particle image analyzer equipped with, as the object lens, a "UPlanApro" (enlargement, 10×; numerical aperture, 0.40), and using the particle sheath "PSE-900A" (from Sysmex Corporation) as a sheath reagent. The dispersion prepared according to the procedure described above was introduced to the flow-type particle image analyzer and, in the HPF measurement mode, 3,000 toner particles were measured in the total count mode. Next, setting the binarization threshold during particle analysis to 85%, and restricting the analyzed particle diameter to a circle-equivalent diameter of at least 1.985 μm and less than 39.69 μm, the average circularity of the toner was determined.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). It is preferable to subsequently carry out focal point adjustment every 2 hours following the start of measurement.

In this invention, use is made of a flow-type particle image analyzer for which the calibration work by Sysmex Corporation was carried out and for which a calibration certification issued by Sysmex Corporation was received. Aside from limiting the diameters of the analyzed particle to a circle-equivalent diameter of at least 1.985 μm and less than 39.69 μm, measurement is carried out under the measurement and analysis conditions at the time that the calibration certificate was received.

The measurement principle employed in the FPIA-3000 (from Sysmex Corporation) flow-type particle image analyzer is to capture the flowing particles as still images and carry out image analysis. The sample that has been added to the sample chamber is fed to a flat sheath flow cell with a sample suctioning syringe. The sample fed into the flat sheath flow cell is sandwiched between the sheath reagent, forming a flattened flow. The sample passing through the flat sheath flow cell is irradiated at 1/60-second intervals with a strobe light, enabling the flowing particles to be captured as still images. Because the flow is flattened, the images are captured in a focused state. The particle images are captured with a CCD camera, and the captured images are image processed with a 512×512 pixel image processing resolution (0.37 μm×0.37 μm per pixel), following which contour extraction is carried out on each particle image, and the projected area S, periphery length L and the like for the particle image are calculated.

Next, the circle-equivalent diameter and circularity are determined using the above surface area S and periphery length L. The circle-equivalent diameter is the diameter of the circle that has the same area as the projected area of the particle image. The circularity is defined as the value provided by dividing the circumference of the circle determined from the circle-equivalent diameter by the periphery length of the particle's projected image and is calculated using the following formula.

$$\text{Circularity}=2\times(\pi\times S)^{1/2}/L$$

When the particle image is circular, the circularity is 1.000. As the degree of unevenness in the circumference of the particle image becomes larger, the circularity value becomes smaller. After calculating the circularity of each particle, the range in circularity from 0.200 to 1.000 is divided by 800, the arithmetic mean of the resulting circularities is calculated, and the resulting value is treated as the average circularity.

Method of Measuring the Amount of Total Energy (TE)

In this invention, the TE is measured using a powder flowability analyzer equipped with a rotary propeller-type blade (Powder Rheometer FT-4, from Freeman Technology; abbreviated below as "FT-4").

Figure 6:
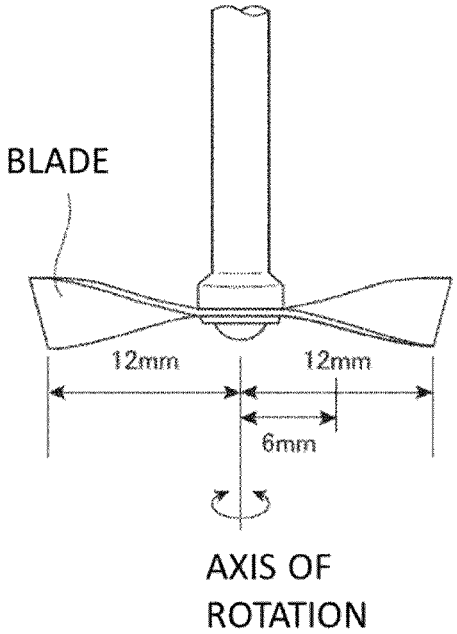
FIG. 6 is a 23.5 mm diameter propeller-type blade specialized for use in FT-4 measurement.
Figure 6:
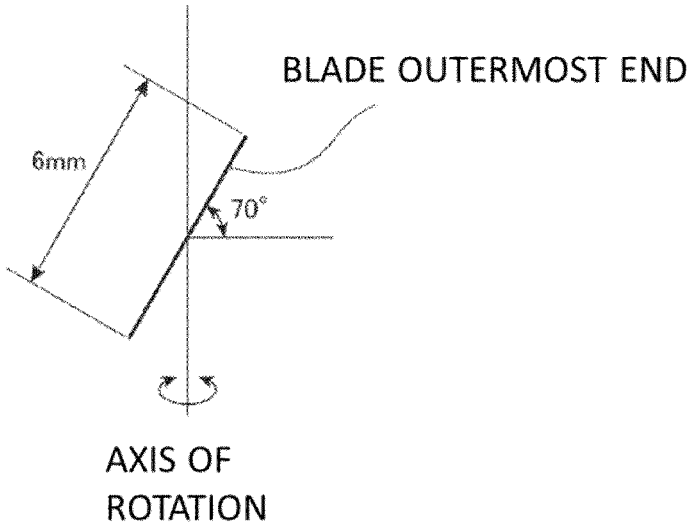

Specifically, measurement is carried out by the following operations. In all the operations, the propeller blade used is a 23.5 mm diameter blade for use in FT-4 measurement (see FIG. 6A. An axis of rotation exists in the normal direction at the center of the 23.5 mm×6.5 mm blade plate. The blade plate is smoothly twisted counterclockwise to 70° at both outermost end portions thereof (the portions 12 mm from the axis of rotation), and 35° at portions 6 mm from the axis of rotation (see FIG. 6B). The blade material is SUS stainless steel).

First, 24 g of toner that had been left to stand in a 23° C., 60% RH environment for 3 days was placed in a specialized vessel for use in FT-4 measurement (a 25 mm diameter, 25 mL volume split vessel (model No.: C4031); height from vessel bottom to split portion, about 51 mm; referred to below simply as the "vessel") and compacted under pressure to form a toner powder layer.

A piston for compacting tests (diameter, 24 mm; height, 20 mm; lined on the bottom with a mesh) is used instead of the propeller blade for compacting the toner.

(1) Toner Compacting Operation:

First, 8 g of toner was placed in the above-described FT-4 measurement vessel. A compression piston for FT-4 measurement is mounted, and compression at 40 N is carried out for 60 seconds. Eight grams of toner is again added and the compression operation is similarly carried out a total of three times, resulting in the presence of a total of 24 g of compacted toner within the special vessel.

(2) Splitting Operation:

The toner powder layer is scraped flat at the split portion of the special vessel for FT-4 measurement, and the toner at the top of the toner powder layer is removed, thereby forming toner powder layers each having the same volume (25 mL).

(3) Measurement Operations:

(A) The propeller blade, while being rotated clockwise with respect to the surface of the toner powder layer (in the direction where blade rotation does not push in the toner powder layer) and at a blade peripheral velocity (peripheral velocity at outermost end of blade) of 10 mm/sec, is advanced into the toner powder layer, in the vertical direction and at a speed of entry such that the angle formed between the path traced by the outermost end of the blade during movement and the powder layer surface (which angle is referred to below as the "blade path angle") becomes 5 degrees, to a position 10 mm from the bottom of the toner powder layer.

(B) Next, the propeller blade, while being rotated in the clockwise direction with respect to the toner powder layer surface at a blade peripheral velocity of 60 mm/sec, is advanced into the toner powder layer, in the vertical direction and at a speed of entry such that the blade path angle becomes 2 degrees, to a position 1 mm from the bottom of the toner powder layer.

(C) Next, the propeller blade, while being rotated in the counterclockwise direction with respect to the toner powder layer surface at a blade peripheral velocity of 10 mm/sec, is drawn out of the toner powder layer, in the vertical direction and at a speed of withdrawal such that the blade path angle becomes 5 degrees, to a position 80 mm from the bottom of the toner powder layer. Once withdrawal is complete, the blade is alternately rotated a little in the clockwise and counterclockwise directions so as to knock off toner that is attached to the blade.

In above measurement operation (A), the propeller blade is advanced while being rotated into the toner powder layer within the vessel and, with measurement beginning at a position 60 mm from the bottom of the toner powder layer and continuing to a position 10 mm from the bottom, the sum of the rotational torque and perpendicular load obtained while advancing the propeller blade is treated as the TE. The resulting TE is divided by the toner density within the cell during measurement (the toner density is automatically measured by the FT-4), giving the "TE/density" value in the invention. The reason for dividing by density is to eliminate factors such as the packing efficiency at the time of measurement.

Method of Measuring Static Friction Coefficient

The static friction coefficient of the toner with respect to a polycarbonate resin substrate is measured using a powder flowability measuring apparatus (ShearScan TS-12, from Sci-Tec Inc.). The ShearScan is an apparatus that carries out measurement by a principle according to the Mohr-Coulomb Model described in "*Characterizing Powder Flowability* (published Jan. 24, 2002)" by Prof. Virendra M. Puri.

Operation is carried out as follows.

Using a linear shear cell (cylindrical, with a diameter of 80 mm and a volume of 140 $cm^3$) which is capable of linearly applying a shear force in a cross-sectional direction, measurement is carried out in a room temperature environment (23° C., 60% RH). The polycarbonate resin substrate indicated below is placed at the bottom of this cell, toner is charged into the cell, and a given vertical load is applied. A consolidated powder layer is created so as to achieve a highest density packed state at this vertical load. Next, while a vertical load continues to be applied, a shear force is gradually applied to the consolidated powder layer, and the shear force at the time that the member on the bottom face serving as the object of static friction measurement (in this case, the polycarbonate resin substrate) has moved is measured.

This measurement is carried at 3.0 kPa, 6.0 kPa, 9.0 kPa, 12.0 kPa, 15.0 kPa and 18.0 kPa, the vertical load is plotted on the horizontal axis and the shear force when the bottom face moved is plotted on the vertical axis, and a straight line approximation is carried out. The slope of the resulting straight-line approximation is treated as the static friction coefficient.

The polycarbonate resin substrate used for measurement is obtained by coating polycarbonate resin onto a substrate with a bar coater or the like, then drying with a vacuum dryer. The polycarbonate resin has a weight-average molecular weight (Mw) of 39,000 and has the molecular structure indicated by structural formula (1) below. The Rz value (JIS B0601: ten-point average roughness) is 0.53. The Rz value has a range similar to that of the Rz value obtained in the general production step for an actual electrostatic latent image bearing member (photoreceptor) composed primarily of polycarbonate.

In the structural formula below, the "H" indicates that the ring in which it is located is not a benzene ring, but rather a cyclohexane ring.

Structural Formula (1)

[C1]

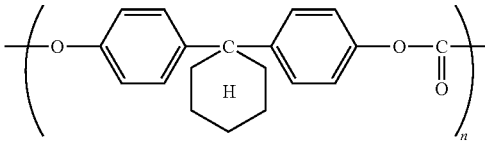

EXAMPLES

The invention is described more fully below by way of working examples and comparative examples, although the invention is in no way limited thereby. Unless noted otherwise, all references in the working examples and the comparative examples to parts and % are by mass.

<Example of the Preparation of Magnetic Body 1>

An aqueous solution containing ferrous hydroxide was prepared by mixing, in an aqueous solution of ferrous sulfate: 1.00 to 1.10 equivalents of sodium hydroxide solution (elemental iron basis), $P_2O_5$ in an amount corresponding to 0.15 mass % (elemental phosphorus to elemental iron basis), and $SiO_2$ in an amount corresponding to 0.50 mass % (elemental silicon to elemental iron basis). The pH of the aqueous solution was set to 8.0 and an oxidation reaction was carried out at 85° C. while blowing in air, thereby preparing a slurry containing seed crystals.

Next, an aqueous solution of ferrous sulfate was added to this slurry in an amount corresponding to 0.90 to 1.20 equivalents with respect to the initial amount of alkali (sodium component of sodium hydroxide). The slurry was then maintained at pH 7.6 and the oxidation reaction made to proceed while blowing in air, giving a slurry containing magnetic iron oxide. Following filtration and washing, this water-containing slurry was temporarily removed. At this time, a small amount of the water-containing sample was collected and the water content was measured. The water-containing sample was then poured, without drying, into another aqueous medium and stirred, and the slurry was re-dispersed therein with a pin mill while being circulated, and the pH of the re-dispersion was adjusted to about 4.8. Next, 1.6 mass parts of n-hexyltrimethoxysilane coupling agent per 100 mass parts of magnetic iron oxide (the amount of magnetic iron oxide was calculated as the value obtained by subtracting the water content from the water-containing sample) was added. Stirring was then thoroughly carried out, the pH of the dispersion was set to 8.6, and surface treatment was carried out. The hydrophobic magnetic body thus produced was filtered with a filter press and rinsed with excess water, then dried at 100° C. for 15 minutes and at 90° C. for 30 minutes. The resulting particles were subjected to pulverizing treatment, and a magnetic body 1 having a volume-average particle diameter of 0.21 μm was obtained.

<Example of the Preparation of Polyester Resin 1>

A reactor fitted with a condenser, a stirrer and a nitrogen inlet was charged with the following ingredients, and the reaction was carried out for 10 hours at 230° C. and under a stream of nitrogen while distilling off water that forms.

| | |
|---|---|
| Bisphenol A 2-mole propylene oxide adduct | 75 mass parts |
| Bisphenol A 3-mole propylene oxide adduct | 25 mass parts |
| Terephthalic acid | 100 mass parts |
| Titanium catalyst (titanium dihydroxybis(triethanolaminate)) | 0.25 mass parts |

Next, the reaction was carried out under a pressure of 5 to 20 mmHg. When the acid value had fallen to 2 mg KOH/g or less, the system was cooled to 180° C., 10 mass parts of trimellitic anhydride was added, and the reaction was carried out for 2 hours at standard temperature and under closed conditions. The product was then removed, cooled to room temperature and pulverized, giving Polyester Resin 1. The resulting Polyester Resin 1 had a main peak molecular weight (Mp), as measured by gel permeation chromatography (GPC) of 10,500.

<Production of Toner Particle 1>

An aqueous medium containing a dispersion stabilizer was obtained by pouring 450 mass parts of a 0.1 M aqueous solution of $Na_3PO_4$ into 720 mass parts of ion-exchanged water and warming the same to 60° C., then adding 67.7 mass parts of a 1.0 M aqueous solution of $CaCl_2$.

| | |
|---|---|
| Styrene | 78.0 mass parts |
| n-Butyl acrylate | 22.0 mass parts |
| Divinylbenzene | 0.6 mass parts |
| Iron complex of monoazo dye (T-77: from Hodogaya Chemical Co., Ltd.) | 3.0 mass parts |
| Magnetic Body 1 | 90.0 mass parts |
| Polyester Resin 1 | 5.0 mass parts |

A polymerization monomer composition was obtained by uniformly dispersing and mixing the above formulation using an attritor (Mitsui Miike Chemical Engineering Machinery). The resulting polymerizable monomer composition was warmed to 65° C. and 15.0 mass parts of Fischer-Tropsche wax (melting point, 75° C.; number-average molecular weight Mn, 500) was added, mixed and dissolved, following which 7.0 mass parts of dilauroyl peroxide was dissolved as a polymerization initiator, giving a toner composition.

The toner composition was poured into the above aqueous medium, then agitated at 12,000 rpm for 10 minutes in a TK Homomixer (Tokushu Kika Kogyo) at 65° C. and in a nitrogen atmosphere, and thereby granulated. Next, the reaction was carried out at 80° C. for 6 hours under stirring with a paddle-type stirring blade.

Following reaction completion, the suspension was cooled, hydrochloric acid was added and cleaning was carried out, followed by filtration and drying, giving Toner Particles 1.

<Production of Toner Particle 2>

[Synthesis of Non-Crystalline Polyester Resin (1)]

| | |
|---|---|
| Dimethyl terephthalate | 136 mass parts |
| Adipic acid | 44 mass parts |
| Trimellitic anhydride | 10 mass parts |
| Bisphenol A 2-mole propylene oxide adduct | 304 mass parts |
| Dibutyltin oxide | 0.8 mass parts |

The above materials were charged into a nitrogen-flushed flask and reacted at 170° C. for 4 hours. In addition, they were reacted under reduced pressure at 200° C., following which water and methanol were removed, giving Non-Crystalline Polyester Resin (1) which was a nonlinear polyester resin.

[Synthesis of Crystalline Polyester Resin (1)]

| | |
|---|---|
| Sebacic acid | 100 mol parts |
| 1,9-Nonanediol | 110 mol parts |
| Dibutyltin oxide | 0.031 mol parts |

The above materials were placed in a nitrogen-flushed flask and reacted, first at 170° C. for 4 hours, then under reduced pressure at 200° C. for 0.5 hours, giving a Crystalline Polyester Resin (1) having a melting point of 70° C.

[Preparation of Binder Resin Particle Dispersion (1)]

An amount of 100 mass parts of Non-Crystalline Polyester Resin (1) was dissolved in 150 mass parts of tetrahydrofuran. While stirring this tetrahydrofuran solution at 10,000 rpm for 2 minutes with a homogenizer (Ultra-Turrax, from IKA Japan), 1,000 mass parts of ion-exchanged water to which had been added, as surfactants, 5 mass parts of potassium hydroxide and 10 mass parts of sodium dodecylbenzenesulfonate was added dropwise. This mixed solution was warmed to about 75° C., thereby removing the tetrahydrofuran. This was followed by dilution with ion-exchanged water to a solids content of 8%, thereby giving Binder Resin Particle Dispersion (1) having a volume-average particle diameter of 0.09 μm.

[Preparation of Binder Resin Particle Dispersion (2)]

Aside from using Crystalline Polyester Resin (1) instead of Non-Crystalline Polyester Resin (1), Binder Resin Particle Dispersion (2) was obtained in the same way as in the preparation of Binder Resin Particle Dispersion (1).

[Preparation of Magnetic Body Particle Dispersion (1)]

| | |
|---|---|
| Magnetic Body 1 | 49 mass parts |
| Ionic surfactant (Neogen RK, from Dai-Ichi Kogyo Seiyaku) | 1 mass part |
| Ion-exchanged water | 250 mass parts |
| Glass beads (diameter, 1 mm) | 250 mass parts |

The above ingredients were charged into a closed, pressure-resistant vessel, dispersion was carried out for 3 hours with a paint shaker (from Toyo Seiki), and the glass beads were removed with a nylon mesh. Next, dilution with ion-exchanged water was carried out to a solids content of 15%, thereby giving Magnetic Body Particle Dispersion (1).

[Preparation of Release Agent Particle Dispersion (1)]

| | |
|---|---|
| Polyethylene wax (PW850, from Toyo Petroleum) | 200 mass parts |
| Ionic surfactant (Neogen RK, from Dai-Ichi Kogyo Seiyaku) | 10 mass parts |
| Ion-exchanged water | 630 mass parts |

The above ingredients were heated to 130° C., then agitated for 2 minutes at 10,000 rpm in a homogenizer (Ultra-Turrax, from IKA Japan) and subsequently cooled to 50° C. Next, dilution with ion-exchanged water was carried out to a solids content of 20%, thereby giving Release Agent Particle Dispersion (1).

[Preparation of Charge Control Agent Particle Dispersion (1)]

| | |
|---|---|
| Dialkylsalicylic acid metal compound (the charge control agent, Bontron E-84, from Orient Chemical Industries Co., Ltd.) | 20 mass parts |
| Anionic surfactant (Neogen SC, from Dai-Ichi Kogyo Seiyaku) | 2 mass parts |
| Ion-exchanged water | 78 mass parts |

The above ingredients were mixed together then agitated at 10,000 rpm for 2 minutes in a homogenizer (Ultra-Turrax, from IKA Japan), giving Charge Control Agent Particle Dispersion (1).

[Production of Toner Particle 2]

| | |
|---|---|
| Binder Resin Particle Dispersion (1) | 80 mass parts |
| Binder Resin Particle Dispersion (2) | 20 mass parts |
| Magnetic Body Particle Dispersion (1) | 63 mass parts |
| Release Agent Particle Dispersion (1) | 20 mass parts |
| Charge Control Agent Particle Dispersion (1) | 20 mass parts |

20 mass parts

The above ingredients were placed in a round-bottomed stainless steel flask, thoroughly mixed and dispersed with a homogenizer (Ultra-Turrax, from IKA Japan). Next, 0.4 mass parts of aluminum polychloride were added to the dispersion and the dispersion operation with the homogenizer (Ultra-Turrax, from IKA Japan) was continued. The flask was heated to 50° C. under stirring on an oil bath and this temperature was held for 60 minutes. In the subsequent melting step, 3 mass parts of an anionic surfactant (Neogen SC, from Dai-Ichi Kogyo Seiyaku) was added, following which the stainless steel flask was closed and, using magnetic seal, was heated to 100° C. and held at that temperature for 5 hours under continued stirring. The flask was cooled, after which the reaction product was filtered and thoroughly rinsed with ion-exchanged water, then dried, giving Toner Particle 2.

<Production of Toner Particle 3>

Aside from changing the retention time at 100° C. in the melting step of "Production of Toner Particle 2" to 2 hours, Toner Particle 3 was obtained in the same way.

<Production of Toner Particle 4>

Preparation of Resin Particle Dispersion (3):

A 2 L separable flask equipped with an anchor blade that imparts stirring power, a reflux apparatus and a vacuum pump was charged with 50 mass parts of ethyl acetate and 110 mass parts of isopropyl alcohol (IPA), and the air within the system was displaced with $N_2$ by passing through $N_2$ at a rate of 0.2 L/m. Next, while heating the system interior to 60° C. with an oil bath unit, 40 mass parts of Binder Resin Particle Dispersion (1) and 160 mass parts of Binder Resin Particle Dispersion (2) were gradually added and dissolved under stirring. Next, 20 mass parts of 10% ammonia water was added, then, using a metering pump, 460 mass parts of ion-exchanged water was charged at a rate of 9.6 g/m under stirring. The interior of the emulsified system exhibited a milky white color, and emulsion was regarded as complete when the stirring viscosity decreased. The pressure was then reduced to 700 torr and the system was stirred for 40 minutes. Next, 50 mass parts of 60° C. pure water was added and stirring was continued for 20 minutes under reduced pressure. When the refluxed amount had reached 210 mass parts, this was treated as the endpoint, heating was stopped and the system was cooled to normal temperature under stirring, giving Resin Particle Dispersion (3).

[Production of Toner Particle 4]

| | |
|---|---|
| Resin Particle Dispersion (3) | 100 mass parts |
| Magnetic Iron Oxide Particle Dispersion (1) | 63 mass parts |
| Release Agent Particle Dispersion (1) | 20 mass parts |
| Charge Control Agent Particle Dispersion (1) | 20 mass parts |

The above ingredients were thoroughly mixed and dispersed in a 60 L reactor using a Cavitron (Taiheiyo Kiko KK). Next, 0.35 mass parts of aluminum polychloride was added, following which the dispersion operation was continued for 10 minutes. The resulting dispersion was transferred to a flask set on an oil bath for heating and was heated to 45° C. under stirring, then held at 45° C. for 30 minutes.

Next, the pH at the system interior was adjusted to 8.0 with a 0.5 mol % aqueous solution of sodium hydroxide, then heated to 85° C. and held at that temperature for 2.5 hours.

Following reaction completion, the resulting slurry was cooled at a rate of 25° C./min using a fluid having a specific heat of 4.22 KJ/Kg·K and a specific gravity of 1.12 g/cm$^3$ as a cryogenic fluid. The slurry was then filtered with a filter press and thoroughly washed with ion-exchanged water, following which solid-liquid separation was carried out with a filter press. The resulting solids were mixed with 40° C. ion-exchanged water, then stirred and washed for 90 minutes at 4,000 rpm with an Ultra-Turrax (IKA Japan), after which a re-slurry wash was carried out for 20 minutes. Next, solid-liquid separation with a filter press was carried out, after which the solids were mixed with 40° C. ion-exchanged water, then again agitated, washed and dried for 50 minutes at 4,000 rpm with an Ultra-Turrax (IKA Japan), giving Toner Particle 4.

<Production of Toner Particle 5>

A 4 L four-neck glass flask was charged with 71.0 mass parts of polyoxypropylene(2.2)-2,2-bis(4-hydroxyphenyl) propane, 28.0 mass parts of terephthalic acid, 1.0 mass part of trimellitic anhydride and 0.5 mass parts of titanium tetrabutoxide, then placed in a mantle heater equipped with a thermometer, a stirring rod, a condenser and a nitrogen inlet. Next, the flask interior was flushed with nitrogen gas, following which the temperature of the flask contents was gradually raised under stirring, and reaction was carried out for 4 hours at a temperature of 200° C. under stirring, thereby giving Polyester Resin 1-1. This Polyester Resin 1-1 had a weight-average molecular weight (Mw) of 80,000, a number-average molecular weight (Mn) of 3,500, and a peak molecular weight (Mp) of 5,700.

In addition, a 4 L four-neck glass flask was charged with 70.0 mass parts of polyoxypropylene(2.2)-2,2-bis(4-hydroxyphenyl)propane, 20.0 mass parts of terephthalic acid, 3.0 mass parts of isophthalic acid, 7.0 mass parts of trimellitic anhydride and 0.5 mass parts of titanium tetrabutoxide, then placed in a mantle heater equipped with a thermometer, a stirring rod, a condenser and a nitrogen inlet. Next, the flask interior was flushed with nitrogen gas, following which the temperature of the flask contents was gradually raised under stirring, and reaction was carried out for 6 hours at a temperature of 220° C. under stirring, thereby giving Polyester Resin 1-2. This Polyester Resin 1-2 had a weight-average molecular weight (Mw) of 120,000, a number-average molecular weight (Mn) of 4,000, and a peak molecular weight (Mp) of 7,800.

50 mass parts of Polyester Resin 1-1 and 50 mass parts of Polyester Resin 1-2 were premixed in a Henschel mixer (from Mitsui Miike Chemical Engineering Machinery), then melt blended in a melt kneader (model PCM-30, from Ikegai Tekko KK) at a rotational speed of 3.3 s$^{-1}$ and a mixed resin temperature of 100° C., giving Binder Resin 1.

| | |
|---|---|
| Styrene | 64.0 mass parts |
| n-Butyl acrylate | 13.5 mass parts |
| Acrylonitrile | 2.5 mass parts |

The above ingredients were then charged into an autoclave and the interior was flushed with $N_2$, following which the temperature was raised and the system was held at 180° C. under stirring. Next, 50 mass parts of a solution of 2 wt % t-butyl hydroperoxide in xylene was continuously added dropwise to the system over 5 hours and cooling was carried out, following which the solvent was separated off and removed, giving Polymer A. The molecular weight of Polymer A was measured, whereupon the weight-average molecular weight (Mw) was 7,000 and the number-average molecular weight (Mn) was 3,000.

| | |
|---|---|
| Binder Resin 1 | 100 mass parts |
| Polymer A | 2 mass parts |
| Fischer-Tropsche wax (peak temperature of maximum endothermic peak, 105° C.) | 4 mass parts |
| Magnetic Body 1 | 95 mass parts |
| Monoazo iron compound (T-77, from Hodogaya Chemical Co., Ltd.) | 2 mass parts |

The above formulation was mixed in a Henschel mixer (model FM-75, from Mitsui Miike Chemical Engineering Machinery), then blended in a twin-screw kneader (mode PCM-30, from Ikegai Tekko KK) set to a temperature of 130° C. The resulting kneaded material was cooled then coarsely pulverized in a hammer mill to a size of 1 mm or less, giving a coarsely pulverized material. The crudely pulverized material was finely pulverized in a mechanical mill (T-250, from Turbo Kogyo KK). In addition, using a multi-grade classifier that utilizes the Coanda effect, classification was carried out, giving resin particles. The resin particles had a weight-average particle diameter (D4) of 6.3 μm.

Heat sphering treatment was carried out on these resin particles. The heat sphering treatment was carried out using a Surface Fusing System (from Nippon Pneumatic Mfg. Co., Ltd.). The operation conditions for the heat sphering apparatus were set as follows: feed rate, 5 kg/hr; hot air current temperature C, 250° C.; hot air current flow rate, 6 $m^3$/min; cooling air temperature E, 5° C.; cooling air flow rate, 4 $m^3$/min; absolute moisture content of cooling air, 3 g/$m^3$; blower air current rate, 20 $m^3$/min; injection air flow rate, 1 $m^3$/min; diffusing air flow rate, 0.3 $m^3$/min.

Through surface treatment under the above conditions, Toner Particle 5 was obtained in which the content of particles having a weight-average particle diameter (D4) of 6.7 μm and a particle diameter of 4.0 μm or less was 18.6 number %, and the content of particles having a particle diameter of 10.1 μm or more was 3.1 vol %.

<Production of Toner Particle 6>

Aside from setting the retention time at 100° C. in the melting step to 7 hours, Toner Particle 6 was obtained in the same way as described above in "Production of Toner Particle 2."

<Production of Toner Particle 7>

Following granulation of the toner composition in an aqueous medium, aside from setting the reaction time at 80° C. under stirring with a paddle stirring blade to 3 hours, Toner Particle 7 was obtained in the same way as in the production of Toner Particle 1 described above.

<Production of Toner Particle 8>

Aside from setting the feed rate to 4 kg/hr and the hot air current flow rate to 7 $m^3$/min, Toner Particle 8 was obtained in the same way as in the Production of Toner Particle 5. In Toner Particle 8, the average circularity was 0.981, the content of particles having a weight-average particle diameter (D4) of 6.7 μm and a particle diameter of 4.0 μm or less was 18.7 number %, and the content of particles having a particle diameter of 10.1 μm or more was 3.1 vol %.

<Production of Toner Particle 9>

In the production of Toner Particle 5, instead of carrying out heat sphering treatment, a mechanical classifying/spheronizing treatment apparatus (the Faculty, from Hosokawa Micron Corporation) was used to carry out 60 seconds of surface treatment at a dispersion rotor speed of 100 $s^{-1}$ (peripheral speed of rotation, 130 m/sec) while removing fine particles at a classification rotor speed of 120 $s^{-1}$, thereby giving Toner Particle 9. The Toner Particle 9 had an average circularity of 0.950, a weight-average particle diameter (D4) of 6.7 μm, a content of particles with a particle diameter of 4.0 μm or less of 15.6 number %, and a content of particles with a particle diameter of at least 10.1 μm of 3.3 vol %.

<Production of Toner 1>

An external addition and mixing process was carried out using the apparatus shown in FIG. 4 on the toner particle 1 provided by Production of Toner Particle 1.

In this working example of the invention, use was made of the apparatus shown in FIG. 4 having a main casing 1 with an inner peripheral portion diameter of 130 mm and having a processing space 9 with a volume of $2.0\times10^{-3}$ $m^3$. The rated power of the drive member 8 was 5.5 kW, and the shape of the stirring member 3 was as shown in FIG. 5. The width of overlap d between the stirring members 3*a* and the stirring members 3*b* in FIG. 5 was set to 0.25 D (based on the maximum width D of the stirring members 3), and the clearance between the stirring members 3 and the inner periphery of the main casing 1 was set to 3.0 mm.

Next, 100 mass parts of Toner Particle 1 and 0.50 mass parts of Silica Fine Particle 1 (obtained by surface treating 100 mass parts of silica (BET specific surface area, 300 $m^2$/g; number-average particle diameter of primary particles, 8 nm) with 30 mass parts of hexamethyldisilazane, then treating 100 mass parts of this treated silica with 10 mass parts of dimethylsilicone oil) were charged into the apparatus shown in FIG. 4.

After charging the toner particles and the silica fine particles, premixing was carried out in order to uniformly mix the toner particles and the silica fine particles. As the premixing conditions, the power of the drive member 8 was set to 0.10 W/g (drive member 8 rotation rate of 150 rpm) and the processing time was set to 1 minute.

After the completion of premixing, external addition and mixing process was carried out. With regard to the conditions for the external addition and mixing process, the processing time was 5 minutes and the peripheral velocity of the outermost end of the stirring member 3 was adjusted to provide a constant drive member 8 power of 0.60 W/g (drive member 8 rotation rate of 1400 rpm).

Figure 3:
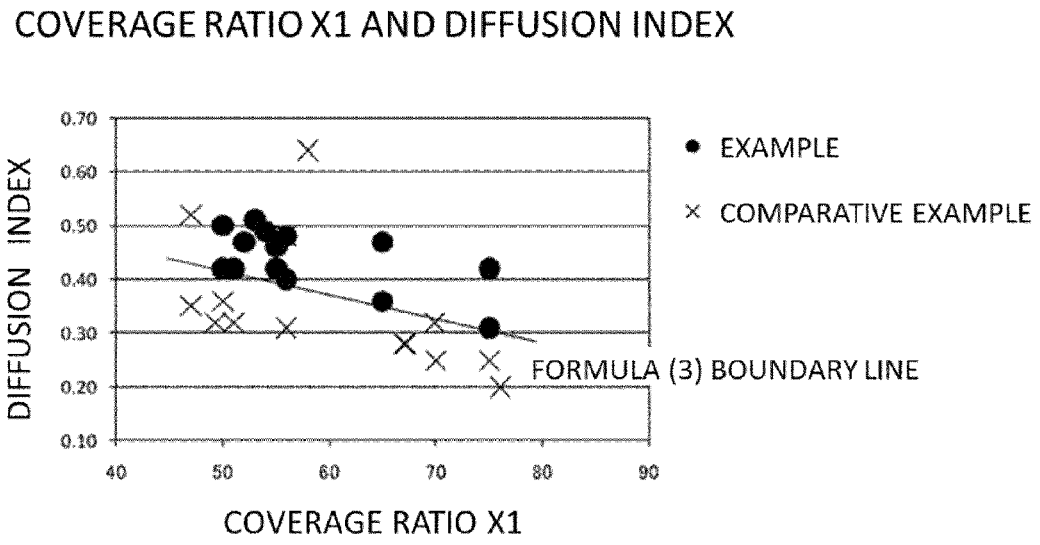
FIG. 3 is a plot of the coverage ratio X1 versus the diffusion index of the toners used in the working examples of the invention and the comparative examples.

Following external addition and mixing process, the coarse particles were removed with a circular oscillating sieve with a diameter of 500 mm equipped with a screen having 75 μm openings, thereby giving Example Toner 1 according to the invention. Example Toner 1 was magnified and examined with a scanning electron microscope, and the number-average particle diameter of primary particles of the silica fine particle on the toner surface was measured and found to be 8 nm. The addition conditions and physical properties of Example Toner 1 are shown in Table 3. In addition, FIG. 3 shows a plot of the coverage ratio X1 versus the diffusion index for Example Toner 1.

<Production of Example Toners 2 to 17, and Comparative Toners 1 to 11>

Aside from changing the silica fine particles to those shown in Tables 1 and 2 and changing the toner particles, external addition apparatus and external addition conditions to those shown in Table 2, Example Toners 2 to 17 according to the invention and Comparative Toners 1 to 11 were produced in the same way as in the production of Example Toner 1. Table 3 shows the properties of the resulting Example Toners 2 to 17 and the properties of the resulting Comparative Toners 1 to 11. FIG. 3 shows a plot of the coverage ratio X1 versus the diffusion index for Example Toners 2 to 17 and for Comparative Toners 1 to 11.

In cases where the external addition apparatus was a Henschel mixer, an FM10C Henschel mixer (Mitsui Miike Chemical Engineering Machinery) was used here. In some of the examples of production, a premixing step was not carried out.

<Production of Comparative Toner 12>

Silica (H30TD, from Clariant) in an amount of 1.75 mass parts was added as the external additive to 100 mass parts of Toner Particle 2, and 15 minutes of mixture at 3,000 rpm was carried out using a Mitsui FM Mixer (FM20C/I, from Mitsui Kozan). In addition, 0.28 mass parts (4.20 g) of a calcium phosphate fine powder (HAP-05NP, from Maruo Calcium Co., Ltd.) was also added, followed by 5 minutes of mixture at 3,000 rpm. The top blade used was a Y0 blade, and the bottom blade was an A0 blade. Mixture was carried out while passing warm water adjusted to 50° C. through the jacket. The temperature on the inside wall of the external addition apparatus was thereby held in a range of (glass transition point temperature of toner −15° C.) to (glass transition point temperature of toner). The mixture was passed through a 200 mesh screen and the coarse particles removed, thereby giving Comparative Toner 12. Table 3 shows the external addition conditions and physical properties of Comparative Toner 12. FIG. 3 shows a plot of the coverage ratio X1 versus the diffusion index for Comparative Toner 12.

<Production of Comparative Toner 13>

Comparative Toner 13 was obtained by adding 0.4 mass parts of polytetrafluoroethylene particles having a number-average particle diameter of 150 nm and 2.0 mass parts of hydrophobic silica fine particle (100 mass parts of silica (BET specific surface area, 300 $m^2/g$; number-average particle diameter of primary particles, 10 nm) that was surface treated with 10 mass parts of hexamethyldisilazane) to 100 mass parts of Toner Particle 2, and blending the ingredients at 800 rpm for 20 minutes in a Henschel mixer (FM10C, from Mitsui Miike Chemical Engineering Machinery). Table 3 shows the external addition conditions and properties for Comparative Toner 13. FIG. 3 shows a plot of the coverage ratio X1 versus the diffusion index for Comparative Toner 13.

<Production of Comparative Toner 14>

Using a Henschel mixer (FM10C, from Mitsui Miike Chemical Engineering Machinery), 2 mass parts of hydrophobic silica in which the primary particles had a number-average particle diameter of 120 nm (X-24, from Shin-Etsu Chemical) and 1 mass part of hydrophobic silica in which the primary particles had a number-average particle diameter of 10 nm (HDK 2000H, from Clariant Japan) were mixed together with 100 mass parts of Toner Particle 2 (blade speed, 2,000 rpm; mixing time, 30 sec; 5 cycles). The mixture was then passed through a screen having 38 μm openings to remove aggregates, thereby giving Comparative Toner 14. Table 3 shows the external addition conditions and physical properties for Comparative Toner 14. FIG. 3 shows a plot of the coverage ratio X1 versus the diffusion index for Comparative Toner 14.

<Production of Comparative Toner 15>

Comparative Toner 15 was obtained by adding 1 mass part of hydrophobic silica (TS720, from Cabot) to 100 mass parts of Toner Particle 4, and mixing at 3,000 rpm for 5 minutes in a Henschel mixer (FM10C, from Mitsui Miike Chemical Engineering Machinery). Table 3 shows the external addition conditions and physical properties for Comparative Toner 15. FIG. 3 shows a plot of the coverage ratio X1 versus the diffusion index for Comparative Toner 15.

<Production of Comparative Toner 16>

An amount of 1.5 mass parts of hydrophobic silica (100 mass parts of silica (BET specific surface area, 300 $m^2/g$; number-average particle diameter of primary particles, 10 nm) that was surface treated with 10 mass parts of hexamethyldisilazane) was added to 100 mass parts of Toner Particle 5, and mixture at a peripheral speed of 40 m/s was carried out for 240 seconds using a Henschel mixer (FM10C, from Mitsui Miike Chemical Engineering Machinery). The mixture was then left at rest for 60 seconds, following which another mixing step was carried out for 240 seconds. The toner thus obtained was designated Comparative Toner 16. Table 3 shows the external addition conditions and physical properties for Comparative Toner 16. In addition, FIG. 3 shows a plot of the coverage ratio X1 versus the diffusion index for Comparative Toner 16.

TABLE 1

| Silica fine particle | BET specific surface area ($m^2/g$) | Number-average particle diameter of primary particles (nm) | Hexamethyldisilazane treatment amount (mass parts) | Dimethyl silicone oil treatment amount (mass parts) |
|---|---|---|---|---|
| Silica Fine Particle 1 | 300 | 8 | 30 | 10 |
| Silica Fine Particle 2 | 100 | 20 | 20 | 10 |

TABLE 2

| | | | | | | External addition conditions | | |
|---|---|---|---|---|---|---|---|---|
| | | Toner particle | Silica fine particle | Amount of silica fine particle added (mass parts) | Content of silica fine particle (mass parts) | Apparatus | Premixing step | External addition step |
| Example 1 | Example Toner 1 | Toner Particle 1 | Silica fine particle 1 | 0.50 | 0.50 | apparatus of FIG. 4 | 0.10 W/g(150 rpm) | 0.60 W/g(1400 rpm) |
| Example 2 | Example Toner 2 | Toner Particle 1 | Silica fine particle 1 | 0.60 | 0.60 | apparatus of FIG. 4 | 0.10 W/g(150 rpm) | 0.60 W/g(1400 rpm) |
| Example 3 | Example Toner 3 | Toner Particle 1 | Silica fine particle 1 | 0.70 | 0.70 | apparatus of FIG. 4 | 0.10 W/g(150 rpm) | 0.60 W/g(1400 rpm) |
| Example 4 | Example Toner 4 | Toner Particle 1 | Silica fine particle 1 | 0.90 | 0.90 | apparatus of FIG. 4 | 0.10 W/g(150 rpm) | 0.60 W/g(1400 rpm) |
| Example 5 | Example Toner 5 | Toner Particle 6 | Silica fine particle 1 | 0.60 | 0.60 | apparatus of FIG. 4 | 0.06 W/g(50 rpm) | 0.60 W/g(1400 rpm) |
| Example 6 | Example Toner 6 | Toner Particle 6 | Silica fine particle 1 | 0.70 | 0.70 | apparatus of FIG. 4 | 0.06 W/g(50 rpm) | 0.60 W/g(1400 rpm) |
| Example 7 | Example Toner 7 | Toner Particle 6 | Silica fine particle 1 | 0.90 | 0.90 | apparatus of FIG. 4 | 0.06 W/g(50 rpm) | 0.60 W/g(1400 rpm) |
| Example 8 | Example Toner 8 | Toner Particle 6 | Silica fine particle 1 | 1.20 | 1.20 | apparatus of FIG. 4 | 0.06 W/g(50 rpm) | 0.60 W/g(1400 rpm) |
| Example 9 | Example Toner 9 | Toner Particle 1 | Silica fine particle 1 | 0.60 | 0.60 | apparatus of FIG. 4 | 0.10 W/g(150 rpm) | 0.47 W/g(1200 rpm) |
| Example 10 | Example Toner 10 | Toner Particle 5 | Silica fine particle 1 | 0.60 | 0.60 | apparatus of FIG. 4 | 0.10 W/g(150 rpm) | 0.67 W/g(1500 rpm) |
| Example 11 | Example Toner 11 | Toner Particle 2 | Silica fine particle 1 | 0.60 | 0.60 | apparatus of FIG. 4 | 0.10 W/g(150 rpm) | 0.60 W/g(1400 rpm) |
| Example 12 | Example Toner 12 | Toner Particle 7 | Silica fine particle 1 | 0.55 | 0.55 | apparatus of FIG. 4 | 0.10 W/g(150 rpm) | 0.47 W/g(1200 rpm) |
| Example 13 | Example Toner 13 | Toner Particle 7 | Silica fine particle 1 | 0.65 | 0.65 | apparatus of FIG. 4 | 0.10 W/g(150 rpm) | 0.63 W/g(1450 rpm) |
| Example 14 | Example Toner 14 | Toner Particle 7 | Silica fine particle 1 | 0.55 | 0.55 | apparatus of FIG. 4 | 0.10 W/g(150 rpm) | 0.37 W/g(1060 rpm) |
| Example 15 | Example Toner 15 | Toner Particle 7 | Silica fine particle 1 | 0.65 | 0.65 | apparatus of FIG. 4 | 0.10 W/g(150 rpm) | 0.63 W/g(1460 rpm) |
| Example 16 | Example Toner 16 | Toner Particle 8 | Silica fine particle 1 | 0.60 | 0.60 | apparatus of FIG. 4 | 0.10 W/g(150 rpm) | 0.60 W/g(1400 rpm) |
| Example 17 | Example Toner 17 | Toner Particle 9 | Silica fine particle 1 | 0.60 | 0.60 | apparatus of FIG. 4 | 0.10 W/g(150 rpm) | 0.50 W/g(1400 rpm) |
| Comparative Example 1 | Comparative Toner 1 | Toner Particle 7 | Silica fine particle 1 | 0.70 | 0.70 | Henschei mixer | — | 4000 rpm |
| Comparative Example 2 | Comparative Toner 2 | Toner Particle 7 | Silica fine particle 1 | 0.90 | 0.90 | Henschei mixer | — | 4000 rpm |
| Comparative Example 3 | Comparative Toner 3 | Toner Particle 7 | Silica fine particle 1 | 1.20 | 1.20 | Henschei mixer | — | 4000 rpm |
| Comparative Example 4 | Comparative Toner 4 | Toner Particle 7 | Silica fine particle 1 | 1.50 | 1.50 | Henschei mixer | — | 4000 rpm |
| Comparative Example 5 | Comparative Toner 5 | Toner Particle 7 | Silica fine particle 1 | 0.45 | 0.45 | apparatus of FIG. 4 | 0.10 W/g(150 rpm) | 0.60 W/g(1400 rpm) |
| Comparative Example 6 | Comparative Toner 6 | Toner Particle 7 | Silica fine particle 1 | 0.45 | 0.45 | apparatus of FIG. 4 | 0.10 W/g(150 rpm) | 0.80 W/g(1700 rpm) |
| Comparative Example 7 | Comparative Toner 7 | Toner Particle 3 | Silica fine particle 1 | 0.60 | 0.60 | apparatus of FIG. 4 | 0.10 W/g(150 rpm) | 0.60 W/g(1400 rpm) |
| Comparative Example 8 | Comparative Toner 8 | Toner Particle 7 | Silica fine particle 1 | 0.60 | 0.60 | apparatus of FIG. 4 | 0.30 W/g(600 rpm) | 0.60 W/g(1400 rpm) |
| Comparative Example 9 | Comparative Toner 9 | Toner Particle 7 | Silica fine particle 1 | 0.60 | 0.60 | Henschei mixer | — | 4000 rpm |
| Comparative Example 10 | Comparative Toner 10 | Toner Particle 7 | Silica fine particle 1 | 0.60 | 0.60 | Henschei mixer | — | 4000 rpm |
| Comparative Example 11 | Comparative Toner 11 | Toner Particle 7 | Silica fine particle 2 | 1.30 | 1.30 | apparatus of FIG. 4 | 0.05 W/g(50 rpm) | 0.60 W/g(1400 rpm) |
| Comparative Example 12 | Comparative Toner 12 | Toner Particle 2 | | | Mentioned in the text | | | |
| Comparative Example 13 | Comparative Toner 13 | Toner Particle 2 | | | Mentioned in the text | | | |
| Comparative Example 14 | Comparative Toner 14 | Toner Particle 2 | | | Mentioned in the text | | | |
| Comparative Example 15 | Comparative Toner 15 | Toner Particle 4 | | | Mentioned in the text | | | |
| Comparative Example 16 | Comparative Toner 16 | Toner Particle 5 | | | Mentioned in the text | | | |

TABLE 3

| | | Average circularity | Static friction coefficient | Coverage ratio X1 (area %) | Coverage ratio X2 (area %) | Diffusion index | Diffusion index lower limit | TE/density (mJ/(g/mL)) |
|---|---|---|---|---|---|---|---|---|
| Example 1 | Example Toner 1 | 0.970 | 0.165 | 50 | 100 | 0.50 | 0.410 | 286 |
| Example 2 | Example Toner 2 | 0.970 | 0.152 | 56 | 117 | 0.48 | 0.385 | 274 |
| Example 3 | Example Toner 3 | 0.970 | 0.142 | 65 | 138 | 0.47 | 0.347 | 263 |
| Example 4 | Example Toner 4 | 0.970 | 0.121 | 75 | 179 | 0.42 | 0.305 | 239 |
| Example 5 | Example Toner 5 | 0.965 | 0.190 | 50 | 119 | 0.42 | 0.410 | 287 |
| Example 6 | Example Toner 6 | 0.965 | 0.182 | 56 | 140 | 0.40 | 0.385 | 270 |
| Example 7 | Example Toner 7 | 0.965 | 0.185 | 65 | 181 | 0.36 | 0.347 | 256 |
| Example 8 | Example Toner 8 | 0.965 | 0.188 | 75 | 242 | 0.31 | 0.305 | 223 |
| Example 9 | Example Toner 9 | 0.970 | 0.114 | 51 | 121 | 0.42 | 0.406 | 283 |
| Example 10 | Example Toner 10 | 0.963 | 0.195 | 55 | 120 | 0.46 | 0.389 | 253 |
| Example 11 | Example Toner 11 | 0.961 | 0.190 | 56 | 117 | 0.48 | 0.385 | 352 |
| Example 12 | Example Toner 12 | 0.966 | 0.131 | 54 | 110 | 0.49 | 0.393 | 295 |
| Example 13 | Example Toner 13 | 0.966 | 0.196 | 53 | 104 | 0.51 | 0.397 | 212 |
| Example 14 | Example Toner 14 | 0.966 | 0.160 | 52 | 111 | 0.47 | 0.402 | 324 |
| Example 15 | Example Toner 15 | 0.966 | 0.190 | 55 | 131 | 0.42 | 0.389 | 192 |
| Example 16 | Example Toner 16 | 0.981 | 0.161 | 55 | 117 | 0.47 | 0.389 | 277 |
| Example 17 | Example Toner 17 | 0.950 | 0.186 | 53 | 117 | 0.45 | 0.397 | 287 |
| Comparative Example 1 | Comparative Toner 1 | 0.966 | 0.223 | 50 | 139 | 0.36 | 0.410 | 302 |
| Comparative Example 2 | Comparative Toner 2 | 0.966 | 0.241 | 56 | 181 | 0.31 | 0.385 | 279 |
| Comparative Example 3 | Comparative Toner 3 | 0.966 | 0.243 | 67 | 239 | 0.28 | 0.339 | 244 |
| Comparative Example 4 | Comparative Toner 4 | 0.966 | 0.233 | 75 | 300 | 0.25 | 0.305 | 209 |
| Comparative Example 5 | Comparative Toner 5 | 0.966 | 0.191 | 47 | 90 | 0.52 | 0.423 | 297 |
| Comparative Example 6 | Comparative Toner 6 | 0.966 | 0.222 | 56 | 117 | 0.48 | 0.385 | 326 |
| Comparative Example 7 | Comparative Toner 7 | 0.950 | 0.317 | 56 | 117 | 0.48 | 0.385 | 403 |
| Comparative Example 8 | Comparative Toner 8 | 0.966 | 0.245 | 51 | 159 | 0.32 | 0.406 | 243 |
| Comparative Example 9 | Comparative Toner 9 | 0.966 | 0.223 | 47 | 134 | 0.35 | 0.423 | 314 |
| Comparative Example 10 | Comparative Toner 10 | 0.966 | 0.288 | 47 | 134 | 0.35 | 0.423 | 335 |
| Comparative Example 11 | Comparative Toner 11 | 0.966 | 0.242 | 58 | 91 | 0.64 | 0.376 | 463 |
| Comparative Example 12 | Comparative Toner 12 | 0.960 | 0.263 | 76 | 380 | 0.20 | 0.301 | 213 |
| Comparative Example 13 | Comparative Toner 13 | 0.960 | 0.235 | 70 | 218 | 0.32 | 0.326 | 334 |
| Comparative Example 14 | Comparative Toner 14 | 0.960 | 0.236 | 67 | 240 | 0.28 | 0.338 | 462 |
| Comparative Example 15 | Comparative Toner 15 | 0.960 | 0.332 | 49 | 154 | 0.32 | 0.413 | 422 |
| Comparative Example 16 | Comparative Toner 16 | 0.963 | 0.320 | 70 | 280 | 0.25 | 0.326 | 562 |

In the table, the diffusion index lower limit indicates the value (−0.0042 × X1 + 0.62) in Formula 2.

Example 1

An HP LASERJET P2055 (from Hewlett Packard) was used as the image-forming apparatus. Because harsher evaluation conditions are used, the cleaning blade was changed from one having a rubber hardness of 70° and a linear pressure of 397 mN/cm over the entire sidewall and at the center in the lengthwise direction of the end face to one having a rubber hardness of 50° and a linear pressure of 300 mN/cm. In addition, by modifying the cartridge, the amount of toner loaded into the cartridge was doubled.

[Evaluation of Cleaning Performance]

Using this modified device and using Example Toner 1, a test was carried out under the harsher evaluation conditions of a low-temperature-low-humidity environment (0° C./about 15% RH). In a low-temperature, low-humidity environment, the cleaning blade becomes hard, making it difficult to stably scrape the surface of the electrostatic latent image bearing member. Cases where image printout is carried out in intermittent mode after the cleaning blade has been sufficiently cooled lead to a large torque, resulting in the harshest evaluation.

The cartridge loaded with above Example Toner 1 was left to stand for 24 hours in the above low-temperature, low-humidity environment, following which a 8,000 pages/day printout test in which horizontal lines having a print percentage of 4% were printed out in a two-page intermittent mode at a rate of 7 seconds/page was carried out for 2 days, then another 1,000 pages were subsequently printed out on the following day (day 3). A4 paper having a weight of 75 g/m$^2$ was used as the recording medium.

Cleaning evaluation was carried out on horizontal line images during the printing of 1,000 pages beginning immediately after the start of horizontal line printing (Evaluation 1 in Table 4), on horizontal line images following use in the 8,000 page durability test and during the printing of 1,000 pages beginning immediately after the start of day 2 of the printout test (Evaluation 2 in Table 4), and on horizontal line images following use in the 16,000 page durability test and during the printing of 1,000 pages beginning immediately after the start of day 3 of the printout test (Evaluation 3 in Table 4). Immediately after the start of day 2 of the printout test following use in the 8,000 page durability test, because the toner developability is somewhat high, the buildup of untransferred toner is at its highest. In addition, the cleaning blade hardens in the low-temperature, low-humidity environment, resulting also in scraping of the electrostatic latent image bearing member surface. Hence, these represent the harshest conditions for evaluating the cleaning performance.

The horizontal line images obtained were visually evaluated, and the cleaning performance was judged based on the following criteria. Also, when faulty cleaning occurs, toner that has slipped through the cleaning blades is present. As a result, because the electrostatic latent image bearing member is incapable of charging in these areas, black stripes are observed.

The specific evaluation criteria were as follows.

A: No black stripes observed.

B: Faint black stripes observed on the image on 10 or fewer pages.

C: Faint black stripes observed on the image on 11 or more pages.

D: Faint black stripes and heavy black stripes observed on the image.

In this evaluation, images having a rating of C or above are regarded as acceptable for practical purposes.

[Evaluation of Image Density]

A chart having a solid image area formed over the entire surface of the printing paper was output consecutively following use in the above 8,000 page durability test and also following use in the 16,000 page durability test. The reflection densities of the solid image areas on the charts thus obtained were measured using a Macbeth densitometer equipped with an SPI filter (from Macbeth). The criteria for evaluating density are shown below.

A: Very good (1.45 and above)

B: Good (at least 1.40 and less than 1.45)

C: Ordinary (at least 1.35 and less than 1.40)

D: Poor (less than 1.35)

In this evaluation, images having a rating of B or higher are regarded as acceptable for practical purposes. Table 4 shows the evaluation results for cleaning performance and image density following use in durability tests.

Examples 2 to 17

Aside from using Example Toners 2 to 17 instead of Example Toner 1, the same procedure was followed as in Example 1 and evaluations were carried out. As a result, it was possible to obtain images that are acceptable for practical purposes with respect to all the properties evaluated. The evaluation results are shown in Table 4.

Comparative Examples 1 to 16

Aside from using Comparative Toners 1 to 16 instead of Example Toner 1, the same procedure was followed as in Example 1 and evaluations were carried out. As a result, the cleaning performance for all the toners had worsened to a level that was practically undesirable. The evaluation results are shown in Table 4.

TABLE 4

| | | Evaluation of cleaning performance | | | Evaluation of image density | |
|---|---|---|---|---|---|---|
| | | Evaluation 1 | Evaluation 2 | Evaluation 3 | After use in 8,000 page durability test | After use in 16,000 page durability test |
| Example 1 | Example Toner 1 | A | A | A | A(1.50) | A(1.45) |
| Example 2 | Example Toner 2 | A | A | A | A(1.51) | A(1.46) |
| Example 3 | Example Toner 3 | A | A | A | A(1.53) | A(1.45) |
| Example 4 | Example Toner 4 | A | A | A | A(1.50) | A(1.47) |
| Example 5 | Example Toner 5 | A | B | A | A(1.48) | B(1.44) |
| Example 6 | Example Toner 6 | A | B | A | A(1.46) | B(1.44) |
| Example 7 | Example Toner 7 | A | B | A | A(1.47) | B(1.43) |
| Example 8 | Example Toner 8 | A | B | A | A(1.47) | B(1.44) |
| Example 9 | Example Toner 9 | A | B | B | A(1.46) | B(1.42) |
| Example 10 | Example Toner 10 | A | B | B | A(1.49) | B(1.41) |
| Example 11 | Example Toner 11 | A | B | C | A(1.47) | B(1.41) |
| Example 12 | Example Toner 12 | A | B | C | A(1.46) | B(1.44) |
| Example 13 | Example Toner 13 | A | B | B | A(1.45) | B(1.42) |
| Example 14 | Example Toner 14 | A | C | B | A(1.45) | B(1.40) |
| Example 15 | Example Toner 15 | A | B | C | A(1.46) | B(1.40) |
| Example 16 | Example Toner 16 | A | B | A | A(1.53) | B(1.43) |
| Example 17 | Example Toner 17 | A | B | A | A(1.47) | B(1.40) |
| Comparative Example 1 | Comparative Toner 1 | B | D | B | A(1.45) | B(1.42) |
| Comparative Example 2 | Comparative Toner 2 | B | D | B | A(1.46) | B(1.41) |
| Comparative Example 3 | Comparative Toner 3 | B | D | B | A(1.46) | B(1.43) |
| Comparative Example 4 | Comparative Toner 4 | B | D | B | A(1.46) | B(1.41) |
| Comparative Example 5 | Comparative Toner 5 | A | D | B | A(1.45) | B(1.40) |
| Comparative Example 6 | Comparative Toner 6 | B | D | C | A(1.46) | B(1.40) |
| Comparative Example 7 | Comparative Toner 7 | A | D | B | B(1.44) | C(1.37) |
| Comparative Example 8 | Comparative Toner 8 | B | D | D | B(1.44) | B(1.44) |
| Comparative Example 9 | Comparative Toner 9 | A | D | D | A(1.45) | B(1.44) |
| Comparative Example 10 | Comparative Toner 10 | A | D | D | B(1.44) | B(1.44) |
| Comparative Example 11 | Comparative Toner 11 | B | D | D | C(1.38) | D(1.34) |
| Comparative Example 12 | Comparative Toner 12 | A | D | B | B(1.43) | B(1.42) |
| Comparative Example 13 | Comparative Toner 13 | A | D | C | B(1.43) | B(1.40) |
| Comparative Example 14 | Comparative Toner 14 | B | D | C | B(1.40) | C(1.37) |
| Comparative Example 15 | Comparative Toner 15 | A | D | C | B(1.40) | C(1.36) |
| Comparative Example 16 | Comparative Toner 16 | A | D | B | B(1.42) | B(1.40) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-144403, filed Jun. 27, 2012, which is hereby incorporated by reference herein in its entirety.

[Reference Signs List]

1 Main casing

2 Rotating member

3, 3*a*, 3*b* Stirring members

4 Jacket
5 Raw material inlet port
6 Product discharge port
7 center shaft
8 Drive member
9 Processing space
10 Rotating member end surface
11 Direction of rotation
12 Backward direction
13 Forward direction
16 Inner piece for raw material inlet port
17 Inner piece for product discharge port
d distance showing the overlapping portion of the stirring members
D stirring member width
100 Electrostatic latent image bearing member (photoreceptor)
102 Toner-carrying member
103 Developing blade
114 Transfer member (transfer charging roller)
116 Cleaner vessel
117 Charging member (charging roller)
121 Laser generator (latent image-forming means, exposure system)
123 Laser
124 Pickup roller
125 Transport belt
126 Fixing unit
140 Developing device
141 Stirring member

The invention claimed is:

1. A toner comprising toner particles, each of which contains a binder resin and a colorant, and silica fine particles, wherein the toner has an average circularity of at least 0.950, the toner has a static friction coefficient, with respect to a polycarbonate resin substrate, of at least 0.100 and not more than 0.200, a coverage ratio Xl of the toner surface by the silica fine particles, as determined by X-ray photoelectron spectroscopy (ESCA), is at least 50.0 area % and not more than 75.0 area %, and when a theoretical coverage ratio of the toner by the silica fine particles is X2, the diffusion index defined in Formula 1 below satisfies Formula 2 below:

$$\text{Diffusion index}=X1/X2 \qquad \text{Formula 1:}$$

$$\text{Diffusion index}\geq -0.0042\times X1+0.62 \qquad \text{Formula 2.}$$

2. The toner according to claim 1, which has a total energy (mJ)/toner density (g/mL) value, as measured with a powder flowability measuring apparatus equipped with a rotary propeller-type blade, of at least 200 mJ/(g/mL) and not more than 300 mJ/(g/mL).

3. The toner according to claim 1, wherein the toner particles are particles obtained by dispersing and granulating, in an aqueous medium, a polymerizable monomer composition containing a polymerizable monomer and a colorant, and then polymerizing the polymerizable monomer contained in the granulated particles.

4. The toner according to claim 1, which has an average circularity of at least 0.960.

5. The toner according to claim 1, wherein the static friction coefficient with respect to a polycarbonate resin substrate is at least 0.150 and not more than 0.200.

6. The toner according to claim 1, wherein the loading of silica fine particles is at least 0.1 mass parts and not more than 5.0 mass parts per 100 mass parts of the toner particles.

* * * * *